US010331087B2

(12) United States Patent
Kotru et al.

(10) Patent No.: US 10,331,087 B2
(45) Date of Patent: Jun. 25, 2019

(54) ATOM INTERFEROMETRY IN DYNAMIC ENVIRONMENTS

(71) Applicant: THE CHARLES STARK DRAPER LABORATORY, INC., Cambridge, MA (US)

(72) Inventors: Krish Kotru, Boston, MA (US); Justin M. Brown, Cambridge, MA (US); David L. Butts, Boston, MA (US); Richard E. Stoner, Framingham, MA (US); Jennifer T. Choy, Cambridge, MA (US); David M. S. Johnson, Somerville, MA (US); Nicole Pomeroy, Waltham, MA (US); Stephen P. Smith, Acton, MA (US); Nancy Wu, Cambridge, MA (US)

(73) Assignee: THE CHARLES STARK DRAPER LABORATORY, INC., Cambridge, MA (US)

( * ) Notice: Subject to any disclaimer, the term of this patent is extended or adjusted under 35 U.S.C. 154(b) by 0 days.

(21) Appl. No.: 15/527,935

(22) PCT Filed: Dec. 3, 2015

(86) PCT No.: PCT/US2015/063753
§ 371 (c)(1),
(2) Date: May 18, 2017

(87) PCT Pub. No.: WO2016/090147
PCT Pub. Date: Jun. 9, 2016

(65) Prior Publication Data

US 2018/0267479 A1 Sep. 20, 2018

Related U.S. Application Data

(60) Provisional application No. 62/086,946, filed on Dec. 3, 2014.

(51) Int. Cl.
*G04F 5/14* (2006.01)
*H05H 3/02* (2006.01)

(52) U.S. Cl.
CPC ..... *G04F 5/14* (2013.01); *H05H 3/02* (2013.01)

(58) Field of Classification Search
CPC ..... G04F 5/14; H05H 3/02
(Continued)

(56) References Cited

U.S. PATENT DOCUMENTS 5,004,325 A 4/1991 Glass et al.
5,274,231 A 12/1993 Chu et al.
(Continued)

OTHER PUBLICATIONS

McGuirk et al. ("Large Area Lgiht Pulse Atom Interferometry", Phys. Rev. Letters, v 85, pp. 4498-4501, (2000).*
(Continued)

*Primary Examiner* — Nicole M Ippolito
*Assistant Examiner* — Hanway Chang
(74) *Attorney, Agent, or Firm* — Lando & Anastasi, LLP

(57) ABSTRACT

Methods and apparatus that provide for inertial sensing. In one example, a method for inertial sensing includes trapping and cooling a cloud of atoms, applying a first beam splitter pulse sequence to the cloud of atoms, applying one or more augmentation pulses to the cloud of atoms subsequent to applying the first beam splitter pulse sequence, applying a mirror sequence to the cloud of atoms, applying a one or more augmentation pulses to the cloud of atoms subsequent to applying the mirror sequence, applying a second beam splitter pulse sequence to the cloud of atoms subsequent to applying the second augmentation pulse, modulating at least one of a phase and an intensity of at least one of the first and the second beam splitter pulse sequences, performing at
(Continued)

least one measurement on the cloud of atoms, and generating a control signal based on the at least one measurement.

13 Claims, 16 Drawing Sheets

(58) Field of Classification Search
USPC ..... 250/251
See application file for complete search history.

(56) References Cited

U.S. PATENT DOCUMENTS

| | | | |
|---|---|---|---|
| 5,274,232 | A | 12/1993 | Chu et al. |
| 6,042,603 | A | 3/2000 | Fisher et al. |
| 8,941,053 | B1 | 1/2015 | Biedermann et al. |
| 9,443,630 | B2 | 9/2016 | Folman et al. |
| 2010/0033256 | A1 | 2/2010 | Strabley et al. |
| 2010/0149541 | A1 | 6/2010 | Aarons et al. |
| 2013/0168541 | A1 | 7/2013 | Stoner et al. |
| 2014/0319329 | A1 | 10/2014 | Bidel et al. |

OTHER PUBLICATIONS

Panfilo et al., "A theoretical and experimental analysis of frequency transfer uncertainty, including frequency transfer into TAI*" Metrologia, vol. 47, 2010, pp. 552-560. DOI: 10.1088/0026-1394/47/5/005.
PCT/US2012/066973, International Preliminary Report on Patentability, dated Jun. 3, 2014.
PCT/US2012/066973, Written Opinion, dated Jun. 2, 2014.
Peik et al., "Bloch Oscillations of Atoms, Adiabatic Rapid Passage, and Monokinetic Atomic Beams," Physical Review A, vol. 55, No. 4, Apr. 1997.
Peters et al., "High-precision gravity measurements using atom interferometry" Metrologia, vol. 38, 2001, pp. 25-61.
Peters et al., "Measurement of gravitational acceleration by dropping atoms" Nature, vol. 400, 1999, pp. 849-852.
Pfeifer et al., "Heterodyne Mixing of Laser Fields for Temporal Gating of High-Order Harmonic Generation", Physical Review Letters, vol. 97, No. 16, Oct. 16, 2006.
Pfeifer et al., "Time-Resolved Spectroscopy of Attosecond Quantum Dynamics", Chemical Physical Letters, Elselvier vol. 463, Nos. 1-3, pp. 11-24, Sep. 22, 2008.
Raith et al., "Attosecond Twin-Pulse Control by Generalized Kinetic Heterodyne Mixing", Optical Letters, vol. 36, No. 2, Jan. 15, 2011, pp. 283-285.
Rakholia et al., "Dual-Axis High-Data-Rate Atom Interferometer via Cold Ensemble Exchange" Physical Review Applied, vol. 2, No. 054012, 2014, pp. 054012-1-054012-8. DOI: 10.1103/PhysRevApplied.2.054012.
Ramsey, N. F., "A Molecular Beam Resonance Method with Separated Oscillating Fields*" Physical Review, vol. 78, No. 6, 1950, pp. 695-699.
Rudolph et al., "A high-flux BEC source for mobile atom interferometers" 2015, pp. 1-22. arXiv: 1501.00403v2.
Sebby-Strabley et al., "Cold Atom Micro Primary Standard (CAMPS)" 43rd Annual Precise Time and Travel Interval (PTTI) Systems and Applications Meeting, 2011, pp. 231-238.
Shah et al., "A Compact and Low-Power Cold Atom Clock" Symmetricom—Technology Realization Center, 2012, Distribution Statement "A", pp. 1-6.
Shore et al., "Laser-induced population transfer in multistate systems: A comparate study" Physical Review A, vol. 45, No. 7, 1992, pp. 5297-5300.
Snadden et al., "Measurement of the Earth's Gravity Gradient with an Atom Interferometer-Based Gravity Gradiometer" Physical Review Letters, vol. 81, No. 5, 1998, pp. 971-974.
Stoner et al., "Analytical Framework for Dynamic Light Pulse Atom Interferometry at Short Interrogation Times", Journal of the Optical Society of America, vol. 28, No. 10, Oct. 2011, pp. 2418-2429.
Storey et al., "The Feynman path integral approach to atomic interferometry. A tutorial" Journal De Physique II, vol. 4, 1994, pp. 1999-2027.
Sugarbaker, A., "Atom Interferometry in a 10 M Fountain" Dissertation, 2014, pp. i-148. http://purl.stanford.edu/kd753jv6128.
Thomas et al., "Observation of Ramsey Fringes Using a Stimulated, Resonsance Raman Transition in a Sodium Atomic Beam" Physical Review Letters, vol. 48, No. 13, 1982, pp. 867-870.
Timmons et al., "Radiation Exposure of Distributed-Feedback Lasers for Use in Atom Trapping and Atom Interfometry", IEEE Transactions on Nuclear Science, vol. 58, No. 2, Apr. 2011, pp. 490-498.
Weitz et al., "Atom manipulation based on delayed laser pulses in three- and four-level systems: Light shifts and transfer efficiencies" Physical Review A, vol. 50, No. 3, 1994, pp. 2438-2444.
Weitz et al., "Atomic Interferometer Based on Adiabatic Population Transfer" Physical Review Letters, vol. 73, No. 19, 1994, pp. 2563-2566.
Wu, X., "Gravity Gradient Survey With a Mobile Atom Interferometer" Dissertation, 2009, pp. i-144.
Young et al., "Precision Atom Interferometry With Light Pulses" Atom Interferometry, 1997, pp. 363-406.
Band, Y.B. "Chirped-Light-Field Atomic-Beam Splitter for Atom Interferometry", Physical Review A, vol. 47, No. 6, Jun. 1993.
Bason et al., "High-fidelity quantum driving" Nature Physics, 2011, vol. 8, pp. 147-152. DOI:10.1038/NPHYS2170.
Bateman et al., "Fractional Adiabatic Passage in Two-Level Systems: Mirrors and Beam Splitters for Atomic Interferometry," The American Physical Society, Physical Review A 76, 013416 (2007), pp. 013416-1-013416-9.
Baum et al., "Broadband and adiabatic inversion of a two-level system by phase-modulated pulses" Physical Review A, vol. 32, No. 6, 1985, pp. 3435-3447.
Bloch et al., "Nuclear Induction" Letters to the Editor, 1946, p. 127.
Bodart et al., "A cold atom pyramidal gravimeter with a single laser beam" Applied Physics Letters, vol. 96, No. 134101, 2010, pp. 134101-1-134101-3. DOI: 10.1063/1.3373917.
Burt et al., "The Cesium Physics Package Design for the PARCS Experiment", Jet Propulsion Laboratory California Institute of Technology, 2004, pp. 71-79.
Butts et al., "Efficient broadband Raman pulses for large-area atom interferometry" Journal of Optical Society of America, vol. 30, No. 4, 2013, pp. 922-927.
Butts, D.L., "Light Pulse Atom Interferometry at Short Interrogation Times for Inertial Navigation" Department of Aeronautics and Astronautics at the Massachusetts Institute of Technology, 2011, pp. 1-150.
Butts et al., "Light Pulse Atom Interfermometry at Short Interrogation Times", Journal of the Optical Society of America, vol. 28, No. 3, Mar. 2011, pp. 416-421.
Butts et al., "Coherent Population Trapping in Raman-Pulse Atom Interferometry", Physical Review A vol. 84 No. 4, 2011, pp. 043613-1-043613-8.
Canuel et al., "Six-Axis Inertial Sensor Using Cold-Atom Interferometry" Physical Review Letters, vol. 97, No. 010102, 2006, pp. 010402-1-010102-4. DOI: 10.1103/PhysRevLett.97.010402.
Chelkowski et al., "Raman Chirped Adiabatic Passage: a New Method for Selective Excitation of High Vibrational States", Journal of Raman Spectroscopy, vol. 28, pp. 459-466, 1997.
Chiow et al., "102hk Large Area Atom Interferometers" Physical Review Letters, vol. 107, No. 12403, 2011, pp. 130403-1-130403-5. DOI: 10.1103/PhysRevLett.107.130403.
Chiow et al., "Noise-Immune Conjugate Large-Area Atom Interferometers" Physical Review Letters, vol. 103, No. 050402, 2009, pp. 020402-1-020402-4. DOI: 10.1103/PhysRevLett.103.050402.
Clade et al., "Large Momentum Beam Splitter Using Bloch Oscillations" Physical Review Letters, vol. 102, No. 240402, 2009, pp. 240402-1-240402-4. DOI: 10.1103/PhysRevLett.102.240402.
Dimopoulos et al., "Atomic gravitational wave interferometric sensor" Physical Review D, vol. 78, No. 122002, 2008, pp. 122002-1-122002-35. DOI: 10.1103/PhysRevD.78.122002.
Dimopoulos et al., "General relativistic effects in atom interferometry" Physical Review D, vol. 78, No. 042003, 2008, pp. 042003-1-042003-29. DOI: 10.1103/PhysRevD.78.042003.

(56) References Cited

OTHER PUBLICATIONS

Esnault et al., "Cold-atom double-A coherent population trapping clock" Physical Review A, vol. 88, No. 042120, 2013, pp. 042120-1-042120-5. DOI: 10.1103/PhysRevA.88.042120.
Esnault et al., "A Compact Cold-Atom Frequency Standard Based on Coherent Population Trapping" in IEEE International Frequency Control Symposium (FCS), 2012 (IEEE, Piscataway, JN, 2012), pp. 1-3.
Everitt et al., "Finite Mixture Distributions" 1981, pp. 1-23.
Fixler et al., "Atom Interferometer Measurement of the Newtonian Constant of Gravity" Science, vol. 315, No. 74, 2007, pp. 74-77. DOI: 10.1126/science.1135459.
Garwood et al., "The Return of the Frequency Sweep: Designing Adiabetic Pulses for Contemporary NMR" Journal of Magnetic Resonance, vol. 153, 2001, pp. 155-177. DOI: 10.1006/jmre.2001.2340.
Geiger et al., "Detecting inertial effects with airborne matter-wave interferometry" Nature Communications, vol. 2, No. 474, 2011, pp. 1-7. DOI: 10.1038/ncomms1479.
Goldner et al., "Momentum Transfer in Laser-Cooled Cesium by Adiabatic Passage in a Light Field" Physical Review Letters, vol. 72, No. 7, 1994, pp. 997-1000.
Gustavson et al., "Rotation sensing with a dual atom-interferometer Sagnac gyroscope" Class. Quantum Grav., vol. 17, 2000, pp. 2385-2398. PII: S0264-9381(00)50380-3.
Hardy et al., "Efficient Adiabatic Fast Passage for NMR Population Inversion in the Presence of Radiofrequency Field Inhomogeneity and Frequency Offsets" Journal of Magnetic Resonance, vol. 66, 1986, pp. 470-482.
Hwang et al., "Fast Broadband Inversion by Adiabatic Pulses" Journal of Magnetic Resonance, vol. 133, article No. MN981441, 1998, pp. 200-203.
International Search Report for PCT/US2015/063753 dated Mar. 31, 2016.
Jefferts et al., "Accuracy evaluation of NIST-F1" Metrologia, vol. 39, 2002, pp. 321-336.
Kasevich et al., "Atomic Interferometry Using Stimulated Raman Transitions" Physical Review Letters, vol. 67, No. 2, 1991, pp. 181-184.
Kasevich et al. "rf Spectroscopy in an Atomic Fountain" Physical Review Letters, vol. 63, No. 6, 1989, pp. 612-615.
Khudaverdyan, M. "Addressing of individual atoms in an optical dipole trap" Diplomarbeit in Physik, Institut fur Angewandte Physik, Nov. 2003, pp. 1-68.
Kitching et al., "Compact atomic clock based on coherent population trapping" Electronics Letters, vol. 37, No. 24, 2001, pp. 1449-1451.
Knappe et al., "A microfabricated atomic clock" Applied Physical Letters, vol. 85, No. 9, 2004, pp. 1460-1462. DOI: 10.1063.11.1787942.
Kotru et al., "Robust Ramsey sequences with Raman adiabatic rapid passage" Physical Review A, vol. 90, No. 053611, 2014, pp. 053611-1-053611-10. DOI: 10.1103/PhysRevA.90.053611.
Kotru et al., "Atom Interferometry via Raman Chirped Adiabatic Passage", CLEO Technical Digest, 2012, 2pgs.
Kovachy et al., "Adiabatic-rapid-passage multiphoton Bragg atom optics" Physical Review A, vol. 86, No. 011606(R), 2012, pp. 011606-1-011616-5. DOI: 10.1103/PhysRevA.86.011606.
Kovachy et al., "Adiabatic-Rapid-Passage Multiphoton Bragg Atom Optics," Phys. Rev. A 86, 011606(R), Jul. 20, 2012, pp. 011606-1-011606-5.
Lutwak, R., "The Chip-Scale Atomic Clock—Recent Developments" Symmetricom—Technology Realization Center, 2009, pp. 573-577.
Malinovsky et al., "General Theory of Population Transfer by Adiabatic Rapid Passage with Intense, Chirped Laser Pulses", The European Physical Journal, vol. 14, No. 2, pgs. 147-155, May 1, 2001.
McGuinness et al., "High data-rate atom interferometer for measuring acceleration" Applied Physics Letters, vol. 100, No. 011106, 2012, pp. 011106-1-011106-4. DOI: 10.1063/1.3673845.
McGuirk et al., "Sensitive absolute-gravity gradiometry using atom interferometry" vol. 65, No. 033608, 2002, pp. 333608-1-033608-14. DOI: 10.1103/PHysRevA.65.033608.
Mescher et al., "An Ultra-Low-Power Physics Package for a Chip-Scale Atomic Clock" Transducers'05, the 13th International Conference on Solid-State Sensors, Actuators and Microsystems, Seoul, Korea, Jun. 5-9, 2005, pp. 311-316.
Monroe et al., "Observation of the cesium clock transition using laser-cooled atoms in a vapor cell" Optics Letters, vol. 16, No. 1, 1991, pp. 50-52.
Muller et al. "Atom Interferometry with up to 24-Photon-Momentum-Transfer Beam Splitters" Physical Review Letters, vol. 100, No. 180405, 2008, pp. 180-405-1-180405-4. DOI: 10.1103/PhysRevLett.100.180405.
Muller et al., "A compact duel atom interferometer gyroscope based on laser-cooled rubidium" The European Physical Journal D, vol. 53, 2009, pp. 273-281. DOI: 10.1140/epjd/e2009-00139-0.
Muller et al., "A precision measurement of the gravitational redshift by the interference of matter waves" Nature, vol. 463, 2010, pp. 926-930. DOI: 10.1038/nature08776.
Muller et al., "Atom Interferometers with Scalable Enclosed Area" Physical Review Letters, vol. 102, No. 240403, 2009, pp. 240403-1-240403-4. DOI: 10.1103/PhysRevLett.102.240403.
Nelson et al., "Cold Atom Micro Primary Standards (CAMPS)" Advanced Sensors and Microsystems Honeywell Aerospace Advanced Technology, 2012, pp. 1094-1098.

* cited by examiner

ATOM INTERFEROMETRY IN DYNAMIC ENVIRONMENTS

CROSS REFERENCE TO RELATED APPLICATIONS

This application is a national stage application under 35 U.S.C. § 371 of International Application No. PCT/US2015/063753 titled "ATOM INTERFEROMETRY IN DYNAMIC ENVIRONMENTS," filed Dec. 3, 2015, which claims priority under 35 U.S.C. § 119(e) to U.S. Provisional Application Ser. No. 62/086,946 titled "ATOM INTERFEROMETRY IN DYNAMIC ENVIRONMENTS," filed Dec. 3, 2014, each of which is incorporated herein by reference in their entirety.

This application is related to commonly owned, co-pending U.S. application Ser. No. 14/958,525 titled "ROBUST RAMSEY SEQUENCES WITH RAMAN ADIABATIC RAPID PASSAGE," filed Dec. 3, 2015, which claims priority from U.S. Provisional Application Ser. No. 62/086,813 titled "ROBUST RAMSEY SEQUENCES WITH RAMAN ADIABATIC RAPID PASSAGE," filed Dec. 3, 2014.

BACKGROUND

Atom interferometry provides a useful tool for precision measurements in geodesy, inertial navigation, and fundamental physics. In light-pulse atom interferometers, stimulated Raman transitions commonly provide the atom optics that coherently split, reflect, and recombine atom wavepackets. U.S. Pat. Nos. 5,274,231 and 5,274,232, each of which is herein incorporated by reference in its entirety, disclose examples of methods and apparatus for manipulating quantum objects, such as atoms, using stimulated Raman transitions. The conventional Raman beamsplitter implementation, which uses resonant pulses to drive atomic transitions, is sensitive to variations in the intensity and difference frequency of the Raman optical fields. These variations can be minimized in a laboratory setting, but will be unavoidably larger in dynamic environments, degrading the performance of practical sensors. In addition, Raman pulses are limited in the thermal velocity range of atoms that can be effectively addressed.

Adiabatic rapid passage (ARP; also known as adiabatic fast passage (AFP)) is a technique used in nuclear magnetic resonance (NMR) to produce rotation of the macroscopic magnetization vector by shifting the frequency of radio frequency (RF) energy pulses (or the strength of the magnetic field) through resonance (the Larmor frequency) in a time that is short compared to the relaxation times. Rather than applying an RF tipping field of fixed orientation and magnitude orthogonal to the holding magnetic field, a field of variable direction is initially applied parallel to an initial polarization and swept into the desired orientation. The polarization is "dragged" while preserving its relative orientation angle with the RF field if the sweep occurs on a timescale much longer than a period of precession about the RF field. One method of varying the RF tipping field direction is by sweeping the RF frequency, as discussed, for example, in U.S. Pat. No. 4,695,799. U.S. Pat. No. 4,695,799 discloses various frequency sweep regimens in the context of NMR.

An optical beamsplitter method using adiabatic rapid passage is discussed in *Atomic interferometer based on adiabatic population transfer*, Weitz et al., Phys. Rev. Lett. Vol. 73, pp 2563-2566 (1994), and in *Precision atom interferometry with light pulses*, B. Young et al., in *Atom Interferometry*, ed. P. Berman (Academic Press, 1996), p. 363. In this method, a pair of laser beams with a fixed laser frequency difference, but having variable laser beam power, was used to achieve atomic population transfer.

SUMMARY

According to one embodiment, a method for inertial sensing is provided. The method comprises trapping and cooling a cloud of atoms to a predetermined temperature, applying a first beam splitter pulse sequence to the cloud of atoms, applying a first augmentation pulse to the cloud of atoms, after a first predetermined dwell time, applying a mirror sequence to the cloud of atoms subsequent to applying the first augmentation pulse, applying a second augmentation pulse to the cloud of atoms subsequent to applying the mirror sequence, after a second predetermined dwell time, applying a second beam splitter pulse sequence to the cloud of atoms subsequent to applying the second augmentation pulse, modulating at least one of a phase and an intensity of at least one of the first and the second beam splitter pulse sequences, performing at least one measurement on the cloud of atoms during an interrogation time, and generating a control signal based on the at least one measurement.

In one example of the method, each of the first and the second augmentation pulses are at least one of a Raman pulse, a composite pulse, and an adiabatic rapid passage (ARP) sweep. According to a further example, the first and the second augmentation pulses are ARP sweeps. According to another example, each of the first and the second augmentation pulse comprises 4N augmentation pulses, wherein N is a value greater than 0. According to a further example, N is at least 2. According to another example, N is 7.

According to one example, the method further comprises applying a third augmentation pulse subsequent the first augmentation pulse and prior to applying the mirror sequence. According to another example, the method further comprises applying a fourth augmentation pulse subsequent the second augmentation pulse and prior to applying the second beam splitter pulse sequence.

In one example, the first and the second beam splitter pulse sequences are $\pi/2$ adiabatic rapid passage (ARP) pulse sequences. According to another example, the mirror sequence is a $\pi$ ARP sequence.

In accordance with some examples, the predetermined temperature is at least 9 μK. In some examples, at least one of the first and the second predetermined dwell times are at least 3 $\pi$ pulse durations. According to a further example, the interrogation time is at least 1 msec. According to yet a further example, the interrogation time is at least 8 msec. According to some examples, the at least one measurement is a measured transition probability. According to another example, the at least one measurement is a fractional frequency measurement.

According to some examples, the method further comprises launching the cloud of atoms into an interferometry region. According to certain examples, the interrogation time is in a range from 1 to 17 ms. According to some examples, the at least one measurement is performed subsequent to applying the second beam splitter pulse.

According to another embodiment, a method for inducing momentum transfer is provided. The method comprises trapping and cooling an atom cloud that includes a plurality of atoms, applying a sequence of adiabatic rapid passage (ARP) light pulses to the plurality of atoms to induce momentum transfer, the sequence including: applying a first π/2 ARP sweep, after a first dwell time subsequent to the first π/2 ARP sweep, applying a mirror it ARP sweep, and after a second dwell time subsequent to the mirror it ARP sweep, applying a second π/2 ARP sweep, applying a sequence of augmentation pulses to the plurality of atoms to induce additional momentum transfer, the sequence including: applying at least one augmentation pulse subsequent to applying the first π/2 ARP sweep and prior to applying the mirror ARP sweep, and applying at least one augmentation pulse subsequent to applying the mirror ARP sweep and prior to applying the second π/2 ARP sweep, modulating at least one of a phase and an intensity of at least one of the first and the second π/2 ARP sweeps, performing at least one measurement associated with induced momentum transfer of the atom cloud, and generating a control signal based on the at least one measurement. According to one example, the at least one measurement includes measuring at least one of an acceleration and a rotation of at least a portion of the plurality of atoms forming the atom cloud.

According to another embodiment, an atom interferometer is provided. The atom interferometer comprises an atom cloud including a plurality of atoms, a trap configured to trap and cool the plurality of atoms to a predetermined temperature and launch the plurality of atoms into an interferometry region, at least one laser light source disposed adjacent to the interferometry region and configured to apply a sequence of adiabatic rapid passage (ARP) light pulses to the interferometry region, an electro-optic modulator coupled to the at least one laser light source and configured to sweep a Raman detuning frequency of the light pulses, an amplifier coupled to the at least one laser light source and configured to modulate an optical intensity of the at least one laser light source, and a controller coupled to the at least one laser light source, the electro-optic modulator, and the amplifier and configured to: direct the sequence of ARP light pulses at the atom cloud to induce adiabatic transitions between internal quantum levels of at least a fraction of the plurality of atoms during the sequence of ARP light pulses, and obtain at least one measurement from the atom cloud based on the adiabatic transitions.

According to one example, the at least one laser light source is further configured to apply a sequence of augmentation pulses to the interferometry region and the controller is further configured to direct the sequence of augmentation pulses. According to a further example, the at least one laser light source comprises counter-propagating beams of light directed at the atom cloud.

According to one embodiment, a method for atomic time-keeping is provided. The method comprises trapping and cooling a cloud of atoms to a predetermined temperature, applying a first beam splitter pulse sequence to the cloud of atoms, after a first predetermined dwell time, applying a second beam splitter pulse sequence to the cloud of atoms subsequent to applying the first beam splitter pulse sequence, modulating at least one of a phase and an intensity of at least one of the first and the second beam splitter pulse sequences, performing at least one measurement on the cloud of atoms during an interrogation time following the second beam splitter pulse sequence, and generating a clock signal based on the at least one measurement.

In one example, the clock signal achieves an Allan deviation of 8e-13 at $\tau$=200 seconds for measurements acquired at 0.89 Hz.

Still other aspects, embodiments, and advantages of these example aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. Embodiments disclosed herein may be combined with other embodiments, and references to "an embodiment," "an example," "some embodiments," "some examples," "an alternate embodiment," "various embodiments," "one embodiment," "at least one embodiment," "this and other embodiments," "certain embodiments," or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF DRAWINGS

Various aspects of at least one embodiment are discussed below with reference to the accompanying figures, which are not intended to be drawn to scale. The figures are included to provide an illustration and a further understanding of the various aspects and embodiments, and are incorporated in and constitute a part of this specification, but are not intended as a definition of the limits of any particular embodiment. The drawings, together with the remainder of the specification, serve to explain principles and operations of the described and claimed aspects and embodiments. In the figures, each identical or nearly identical component that is illustrated in various figures is represented by a like numeral. For purposes of clarity, not every component may be labeled in every figure. In the figures:

DETAILED DESCRIPTION

Figure 1:
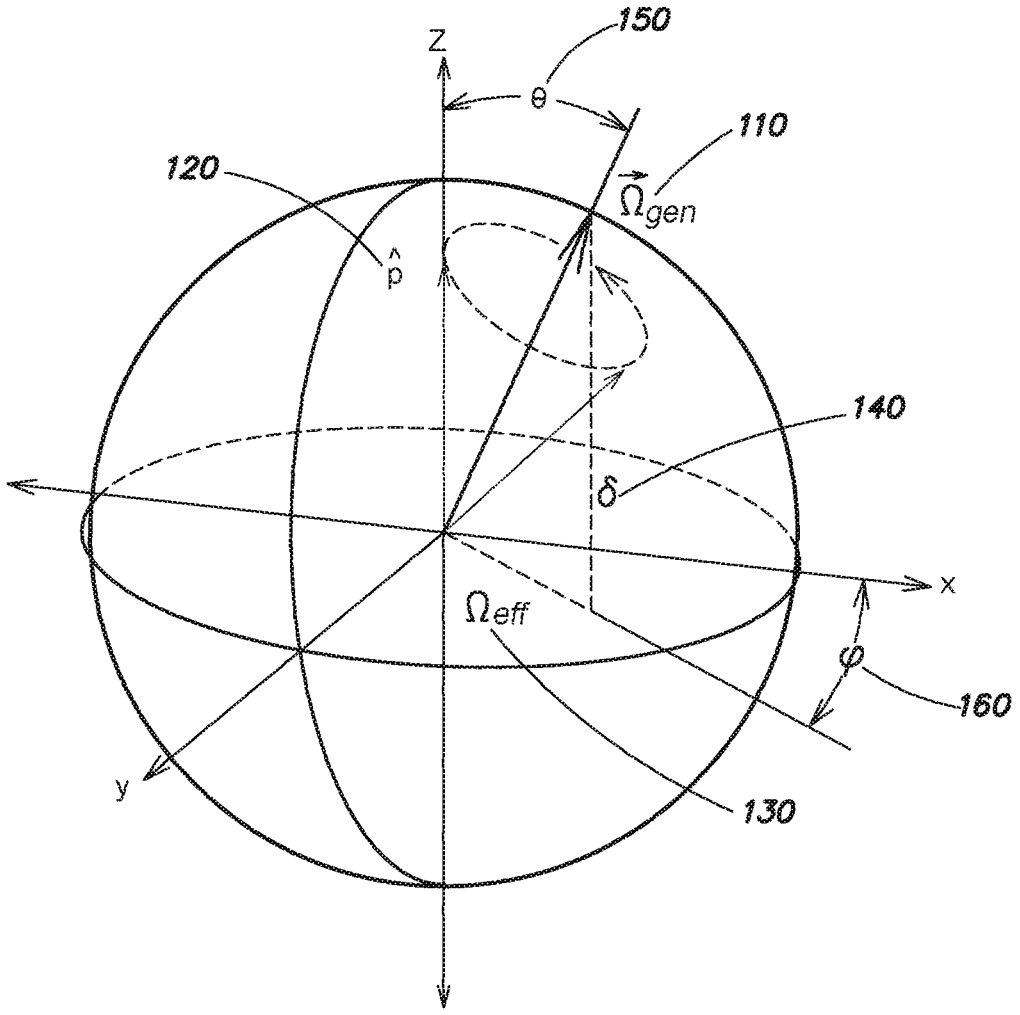
FIG. 1 is a diagram schematically illustrating a Bloch sphere depiction of Raman adiabatic rapid passage according to aspects of the invention.
Figure 2A:
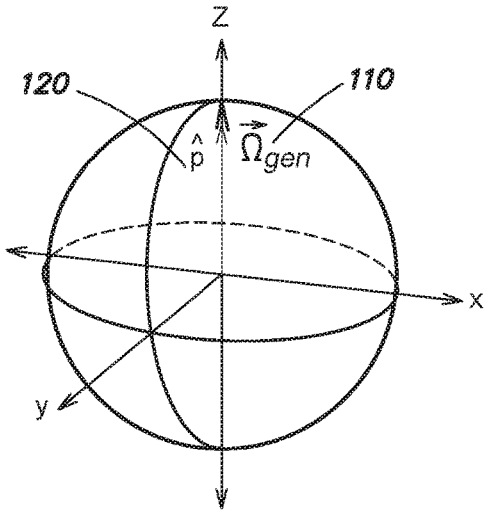
FIG. 2 is a series of diagrams schematically illustrating a Raman ARP Ramsey sequence on a Bloch sphere according to aspects of the invention.
Figure 2B:
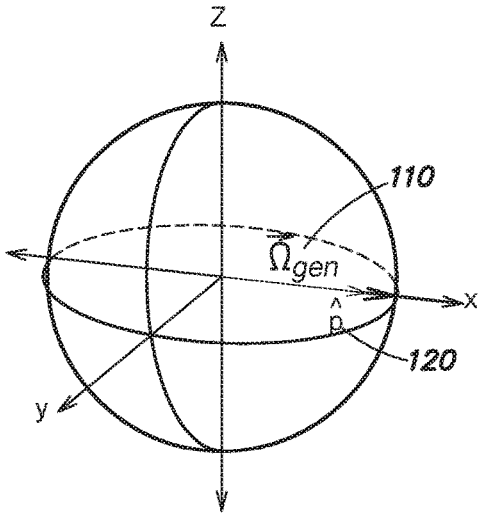
Figure 2C:
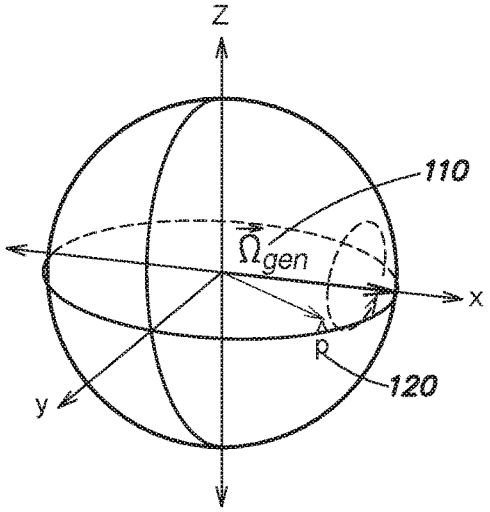
Figure 2D:
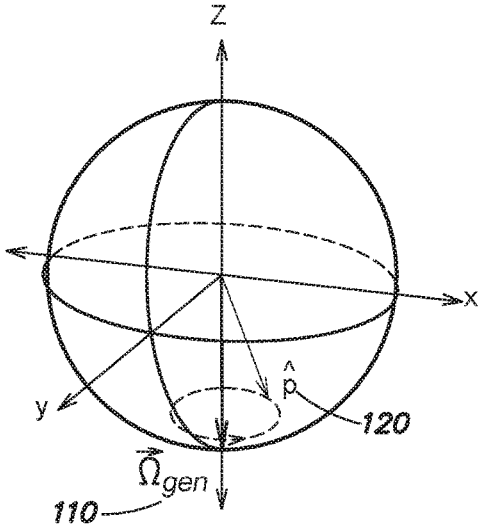

Atom interferometry may be used in a variety of applications, including precision metrology applications such as inertial sensors, accelerometers, and gyroscopes. For example, Raman pulse atom interferometry can be applied to compact atomic clocks, and as an optical interrogation modality, it eliminates the need for antennas and cavities that are typically used in direct microwave interrogation. Thus, the size and complexity of the corresponding system may be reduced. Aspects and embodiments disclosed herein use adiabatic rapid passage (ARP) in timekeeping and large momentum transfer (LMT) inertial sensing applications. In particular, a timekeeping method based on ARP in Raman lightpulse atom interferometry is disclosed that may be applied to compact devices used in dynamic environments. Aspects and embodiments are directed to methods and systems for optical Ramsey interrogation that demonstrates reduced sensitivity to optical beam power variations and other systemic effects. In addition, various aspects are directed to Raman atom interferometry inertial sensing that demonstrates increased sensitivity using LMT based on ARP techniques. According to at least one embodiment, high contrast atomic interference with momentum transfer as high as 30 $\hbar k$ using 9 μK atom clouds is disclosed. The ability to use such relatively "hot" atoms enables operation at high repetition rates for both maximal sensor bandwidth and increased sensitivity.

Typically, high sensitivity in laboratory atom interferometry can be traded for reduced size by shortening the Ramsey dwell time, i.e., the measurement time, and interrogating atoms in the cooling and trapping region (i.e., carrying out both atom trapping and interrogation in the same volume). In dynamic environments, a short measurement time may have the added benefit of reducing unconstrained motion of the atom cloud. For example, if measurements are completed on a 10 ms time scale, then a cold atom cloud experiencing 1-5 g accelerations is displaced from the trap site by <1 cm, which enables recapture of cold atoms and fast data rates with narrow laser beams.

Methods of using microwaves for atomic timekeeping typically require well-engineered cavities or waveguides, which constrain the minimum size obtainable and may be adversely affected by thermal environments or vibrations. Alternative approaches that circumvent the use of a cavity include optically driven stimulated Raman transitions between alkali hyperfine ground states. However, optical interrogation methods introduce separate challenges from microwave interrogation, such as phase errors caused by AC Stark shifts and spatially dependent Rabi rates caused by the Gaussian intensity profile of the laser beam. CPT timekeeping systems using optical fields have been shown to achieve a fractional frequency uncertainty of $2\times10^{-12}$ at 1000 s, with certain magnetic-field instabilities.

Aspects and embodiments are directed to methods and systems for timekeeping that use optical interrogation methods, such as optical Ramsey interrogation, that suppress sensitivity to light shifts and Rabi rate inhomogeneities. The disclosed approach uses atom optics that are based on Raman adiabatic rapid passage (ARP), which may also be referred to herein as Raman chirped adiabatic passage (RCAP), which is inspired by, and isomorphic to the adiabatic rapid passage techniques used in nuclear magnetic resonance (NMR) spectroscopy. According to various aspects, ARP is less sensitive to thermal and spatial distribution of atoms. In ARP, a slow sweep of the radio frequency (RF) frequency preserves the initial angle between the drive field and magnetization vector, thereby allowing efficient population inversion and production of coherences. An atom subject to coherent laser beam pairs is analogous to a classical magnetization subjected to an RF magnetic field of fixed frequency. In this case, the fixed frequency corresponds to the frequency different between the coherent laser beams in the par. Accordingly, a Raman pulse can be considered as an RF field of constant frequency effectively torqueing the classical magnetization about its axis.

In NMR, ARP inverts the population in a two-level system by slowly sweeping the angular frequency of a rotating magnetic field through the Rabi resonance. In the frame of the time-dependent field, the nuclear spin precesses about the effective magnetic field with a latitude that slowly tilts from the north to the south pole. As discussed further below, the Raman ARP approach used herein uses an analogous sweep of the frequency difference of the Raman optical fields through the two-photon resonance. ARP may impart smaller phase errors and may address broader thermal velocity distributions than conventional pulsed techniques for atom interferometry. In addition, RCAP may permit implementation of atom interferometer inertial sensors of improved ability to accommodate highly dynamic environments. Typical beamsplitter techniques using fixed-frequency Raman pulses are sensitive to Doppler-induced detunings that can produce phase errors in dynamic environments. In addition, a primary purpose of a Raman pulse is to accurately imprint the laser phase on the phase of the atomic coherence, and if the pulse is applied off resonance, substantial phase errors may result. This sensitivity may be avoided by using RCAP in lieu of a standard Raman pulse beamsplitter. Specifically, phase errors caused by AC Stark shifts may be greatly reduced by use of RCAP. Raman ARP reduces the phase sensitivity of a Ramsey sequence to the differential AC Stark shift because the first beamsplitter does not imprint a relative phase on the quantum state in the adiabatic limit. ARP is also robust to intensity variations, since transfer efficiency is not a strong function of Rabi rate.

Thus, interferometer contrast is preserved in the presence of intensity fluctuations and gradients, and the phase is insensitive to small changes in frequency sweep parameters, as discussed further below.

Stimulated Raman adiabatic passage (STIRAP) includes applying two resonant Raman beams with separate time-varying intensities to achieve varying orientation of the effective "RF field." Thus, adiabatic transfer in a three-level system results from time-delayed intensity modulations of two optical fields. However, variation of intensity poses significant control and stability problems. Raman ARP differs from STIRAP, and frequency-swept ARP has at least two advantages over STIRAP: (1) in a Ramsey sequence, spontaneous emission during the second STRAP pulse reduces the maximum interferometer contrast by approximately a factor of 2, and (2) the presence of multiple excited levels in alkali-metal atoms reintroduces residual Stark shifts to STIRAP, with dependencies on pulse duration, optical intensity, and single-photon laser detuning. In fact, precision control of laser power (intensity) is far more difficult than precision control of other parameters, such as laser frequency. Raman ARP atom optics according to various embodiments may provide many of the benefits afforded by varied laser intensity, but with fewer drawbacks.

As discussed further below, efficient population inversion and Ramsey interferometry can be achieved based on Raman ARP. Further, Raman ARP may be used to suppress phase deviations due to AC Stark shifts by about a factor of ~100. In addition, deliberate perturbations to frequency sweep parameters do not introduce resolvable shifts in phase. The Raman ARP systems and methods disclosed herein may achieve a fractional frequency uncertainty of $3.5\times10^{-12}$ after 200 s of averaging.

As discussed herein, Raman ARP may also be applied to the problem of enhancing the sensitivity of Raman pulse based acceleration measurements. Such an enhancement may be vital to maintaining adequate inertial sensitivity at the short measurement times necessitated by dynamic environment operation. Large Momentum Transfer (LMT) atom interferometry comprises the use of additional Raman pulses to increase inertial sensitivity. Embodiments discussed herein use ARP events in lieu of Raman pulses to provide this sensitivity enhancement. The product of scale factor (the multiplier to convert an acceleration to an interferometer phase shift) times interferometer contrast (the peak-to-peak excursion in interferometer population transfer as a function of interferometer phase) is proportional to Raman accelerometer SNR. According to various embodiments, this figure of merit is more than three times the corresponding figure for the standard three-pulse interrogation sequence. In other words, in a measurement of a given duration, the ARP-based LMT technique disclosed herein demonstrates the potential to increase measurement sensitivity by ~2×–2.8× (depending on measurement time) compared to standard 3-pulse interferometers.

Frequency-swept ARP may be used for robust population inversion in NMR, and its effect on a two-state system can be visualized on the Bloch sphere shown in FIG. 1. The pseudospin polarization $\hat{p}$ 120 represents a superposition of "spin-up" and "spin-down" states corresponding to $|F=4, m_F=0\rangle$ and $|F=3, m_F=0\rangle$ states, respectively. The generalized Rabi rate $\vec{\Omega}_{gen}$ 110 represents the Raman pulse "drive field" and is analogous to the effective magnetic field in the NMR system. When the drive field is applied, $\hat{p}$ 120 precesses about $\vec{\Omega}_{gen}$ 110 at the generalized Rabi frequency $\Omega_{gen}=\sqrt{\Omega_{eff}^2+\delta^2}$, where $\Omega_{eff}$ 130 is the magnitude of the two-photon Rabi rate, and $\delta=\omega_1-\omega_2-\omega_{HFS}$ (140) is the Raman detuning, and precession can be expressed as $\dot{p}=\vec{\Omega}_{gen}\times\hat{p}$). The polar angle 150 of the drive field is $\theta=-\arctan(\Omega_{eff}/\delta)$. The azimuthal angle $\varphi$ 160 represents the phase difference between the two Raman frequency components. If the drive field undergoes a polar angle rotation at a rate $\dot{\theta}<<\Omega_{gen}$, $\hat{p}$ 120 encircles $\vec{\Omega}_{gen}$ 110 before $\theta$ 150 changes appreciably. As a result, rapid precession causes $\hat{p}$ 120 to adiabatically follow $\Omega_{gen}$ 110. The projection of $\hat{p}$ 120 onto the drive field, which is defined as $\vec{p}\|$, can thus be dragged anywhere on the Bloch sphere. Experimentally, the polar angle $\theta$ 150 is controlled by sweeping the detuning $\delta$ 140 through resonance, over a frequency range that is large in comparison to $\Omega_{eff}$ 130. According to certain aspects, the two-state model is appropriate because the single photon detuning $\Delta$ satisfies $\Delta<<\Omega_{eff}$. This parameter regime allows for adiabatic elimination of all intermediary excited states in the $6^2P_{3/2}$ manifold.

ARP is generally advantageous when inversion is required in the presence of an inhomogeneous drive field. Since the Rabi rate in this case is position dependent, precise control of spin precession cannot be achieved simultaneously over the entire ensemble. As a result, fixed-frequency $\pi$ and $\pi/2$ pulses tend to over- or undershoot the desired pulse area for a given atom. With an ARP sweep, however, transfer efficiency in the adiabatic limit ultimately depends on the projection of $\hat{p}$ onto $\vec{\Omega}_{gen}$, namely $\vec{p}\|$, which is independent of precession. In the typical approach to ARP, $\delta(t)$ is linearly chirped through resonance. According to various embodiments disclosed herein, a nonlinear sweep (i.e., using laser beam pairs in which the frequency difference is swept over time, otherwise referred to as a frequency sweep) is instead performed that rapidly changes the polar angle $\theta$ at the beginning and end of the adiabatic passage, when the adiabatic condition, i.e., the tipping rate is much slower than the rate of precession, is well satisfied. The optical intensity may also be reduced near the beginning and end of the sweep. A short sweep minimizes dephasing attributed to spontaneous emission. The frequency sweep used herein is expressed below by Equation (1):

$$\delta(t) = \Omega_{arp}\tan\left[\alpha\left(\frac{2t}{T_\pi}\right)-1\right],\ t\in\{0, T_\pi\} \qquad \text{Equation (1)}$$

where $T_\pi$ sets the total sweep duration, (a first sweep parameter), $\Omega_{arp}$ controls the sweet rate without perturbing its duration or range, i.e., defines the shape of the ARP frequency sweep (a second sweep parameter), and $\alpha=\arctan(\delta_{max}/\Omega_{arp})$, where $\delta_{max}$ is the maximum detuning (a third sweep parameter).

To quantify the adiabaticity of a particular sweep, a unitless parameter Q(t) is defined where $Q(t)=\Omega gen/|\dot{\theta}|$. Near resonance, and when $\delta>>\Omega_{eff}=\Omega_{arp}$, Q is equivalent to $T_\pi$ in units of Raman $\pi$ pulses. In other words, Q=n, when $T_\pi=nt_\pi$, where $t_\pi$ is the duration of a Raman $\pi$ pulse. According to various aspects, Q≥5 provides sufficient adiabaticity for robust population transfer. According to other aspects, sweeps may begin or end near resonance (when Q is minimized), and Q may have a value of 10 or 26. The frequency sweep described by Equation (1) is coupled with an intensity modulation I(t), which is expressed below by Equation (2):

$$I(t) = I_0 \tanh\left[\beta\left(1 - \left|\frac{2t}{T_\pi} - 1\right|\right)\right] \quad \text{Equation (2)}$$

where $I_0$ is the maximum intensity, and $\beta$ is a unitless parameter having a typical value of 7.5.

Since $I(0)=I(T_\pi)=0$, the drive field at the beginning and end of the sweep is essentially parallel with the z axis of the Bloch sphere. This alignment helps maximize transfer efficiency when atoms are prepared in one of the clock states.

According to various aspects, a simple Bloch model of a two-level atom (i.e., refer to the Bloch sphere of FIG. 1) may be used to predict the transition probability during Raman ARP sweeps. Interferometer sequences may thus be modeled by incorporating a period of free precession about the z axis of the Bloch sphere during the time between two pulses. Following a pulse sequence, the model reports the atom transition probability in response to a varied parameter, such as Raman detuning or phase. The model is also capable of accounting for ensemble effects by repeating the calculation for many atoms with randomly assigned positions and velocities, making $\Omega_{eff}$ a Gaussian function of position, and averaging over the resulting transition probabilities.

Ramsey sequences are commonly viewed as atom interferometers comprising two $\pi/2$ pulses, or beamsplitters, separated by an interrogation time T. An atom beamsplitter divides the atomic wave packet in two, with the resulting partial wave packets assuming different hyperfine and momentum states. In practice, the co-propagating Raman optical fields may impart a negligible momentum kick. A Ramsey sequence derived from these beamsplitters is then primarily an atom interferometer for the internal hyperfine states of the atom. Raman ARP serves as an effective beamsplitter for a Ramsey atom interferometer when the sweep is stopped midway, at the Raman resonance. In part (a) of FIG. 2, the first Ramsey pulse begins with $\vec{\Omega}_{gen}$ 110 and $\hat{p}$ 120 initially parallel after state preparation. The drive field 110 then slowly drags the pseudospin 120 into the x-y plane (see part (b)) creating a coherent superposition of the clock states. Thus, the first sweep transfers the pseudospin polarization into the x-y plane when its center frequency matches the Raman resonance condition. After an interrogation time T, a second beamsplitter starts nearly on resonance to complete the Ramsey sequence. At the beginning of this pulse, $\vec{\Omega}_{gen}$ 110 and $\hat{p}$ 120 are generally nonparallel, because of discrepancies between the oscillator and atomic resonance frequencies—which the atomic reference is intended to correct. The misalignment leads to the precession of $\hat{p}$ 120 about $\vec{\Omega}_{gen}$ 110, as shown in part (c) of FIG. 2. The drive field 110 (second beamsplitter) then drags $\vec{p}\|$ to the z axis (see part (d)) thereby converting the interferometer phase, i.e., the relative phase between the drive field and pseudospin polarization, into population difference.

In ARP, a slow sweep of the radio frequency (RF) frequency preserves the initial angle between the drive field and magnetization vector, thereby allowing efficient population inversion and production of coherences. An atom subject to coherent laser beam pairs is analogous to a classical magnetization subjected to an RF magnetic field of fixed frequency. In this case, the fixed frequency corresponds to the frequency difference between the coherent laser beams in the pair. Accordingly, a Raman pulse can be considered as an RF field of constant frequency effectively torqueing the classical magnetization about its axis.

Referring to FIGS. 3-6B, various types of sweeps may be used in atom interferometers, and may be useful in ARP. For instance, beamsplitter, inversion, combiner, and mirror sweeps, as discussed further below, may be combined together or with standard Raman pulses to implement a variety of different configurations depending on the application. Furthermore, the intensity of the Raman lasers may be systematically varied during the sweeps described below to improve efficiency.

Figure 3:
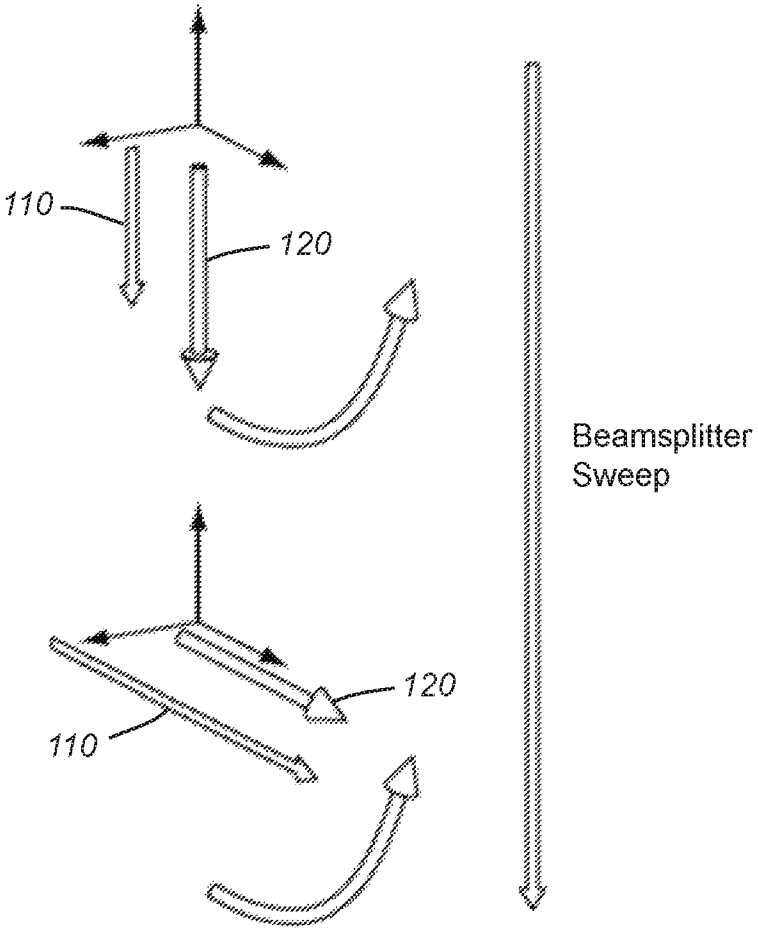
FIG. 3 is a diagram schematically illustrating movement of a polarization on the Bloch sphere caused by rotating the effective drive field according to aspects of the invention.

Referring to FIG. 3, and applying the NMR analogy to the atom, at the start of a frequency sweep, the effective drive field 110 is aligned with the initial polarization 120 of the atomic system, which is analogous to part (a) of FIG. 2 discussed above. As the effective drive field 110 rotates (changes orientation on the Bloch sphere as a result of the time-varying frequency difference), the polarization 120 follows the effective drive field, and as also shown in part (b) of FIG. 2. The drive field may be turned off in the equatorial plane, resulting in an atomic beamsplitter.

Figure 4:
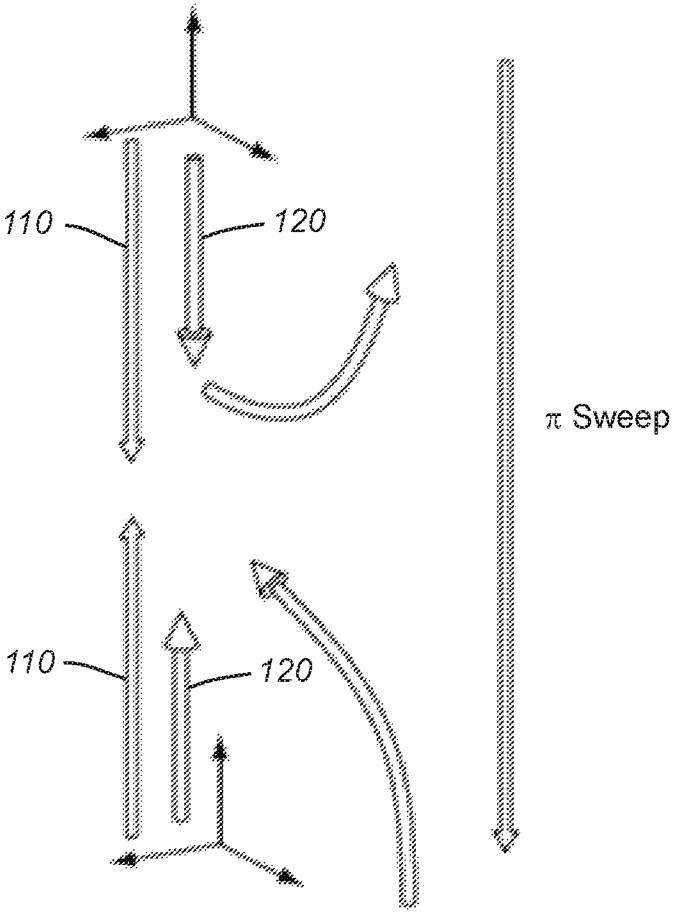
FIG. 4 is a diagram further schematically illustrating that rotation of the effective drive field produces efficient coherent transfer of atomic population from one ground state to another, according to aspects of the invention.

FIG. 4 illustrates how the sweep of FIG. 3 can be continued to the opposite pole, thus comprising an inversion sweep that produces efficient coherent transfer of atomic population from one ground state to another.

Figure 5:
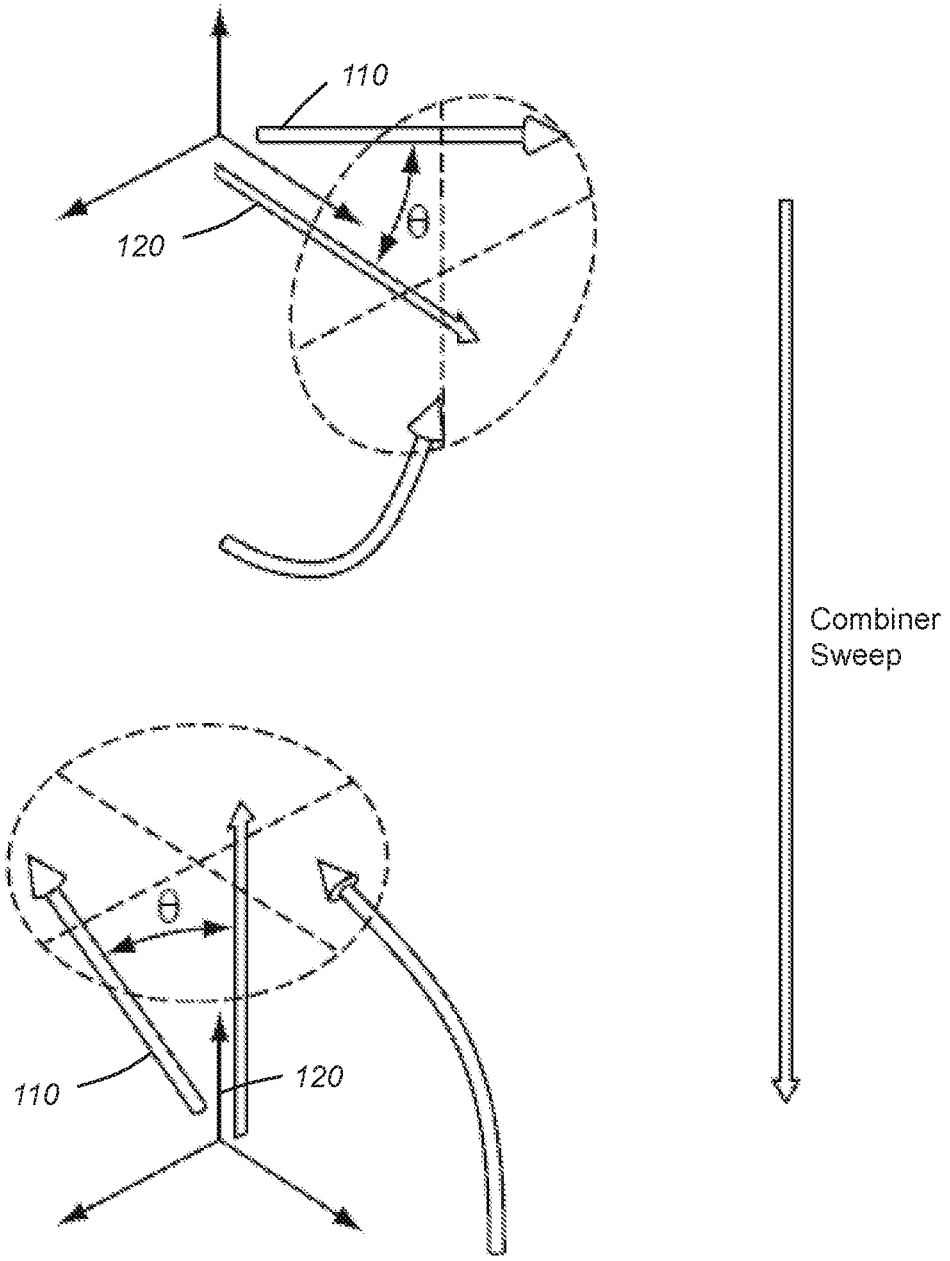
FIG. 5 is a diagram schematically illustrating a combiner frequency sweep in which rotation of the effective drive field causes polarization movement on the Bloch sphere according to aspects of the invention.

FIG. 5 illustrates a combiner sweep, which is analogous to the inverse of the beamsplitter shown in FIG. 3 and part (b) of FIG. 2. In a combiner sweep, the effective drive field 110 is initially on the equatorial plane of the Bloch sphere, at an angle $\theta$ with a polarization 120 that is also oriented in the equatorial plane. As the effective drive field 110 rotates, the polarization 120 precesses about the drive field, but their relative angle of orientation $\theta$ is preserved. When the drive field 110 rotates to polar orientation, the polarization 120 is oriented at an angle $\theta$ with respect to the pole. Measuring the atom's relative ground state population thus reveals the relative phase of the initial polarization with respect to the initial effective drive field.

Figures 6A, 6B:
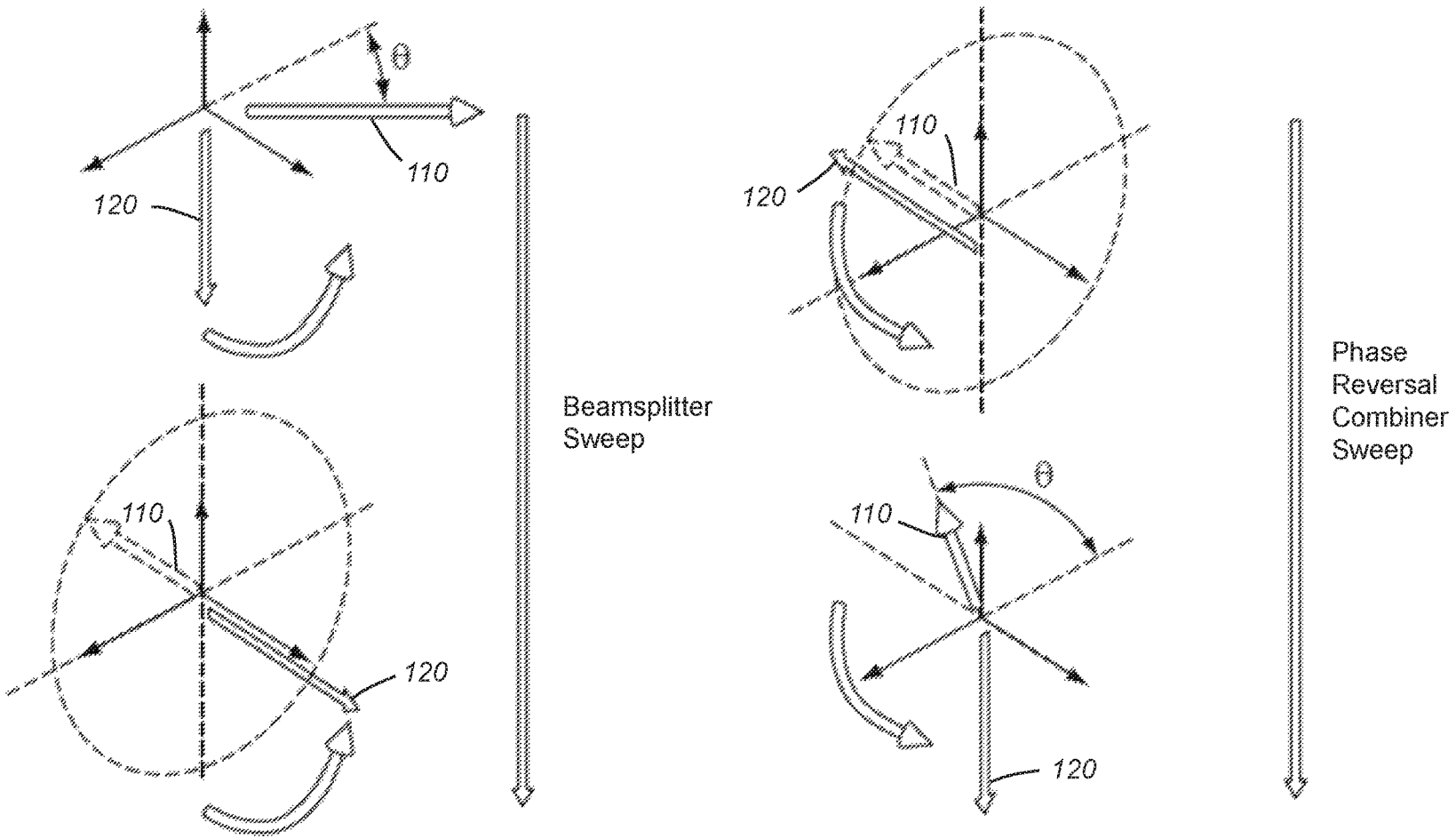
FIG. 6A is a diagram schematically illustrating an RCAP beamsplitter frequency sweep applied to an atomic coherence, according to aspects of the invention.
FIG. 6B is a diagram schematically illustrating a phase reversal combiner frequency sweep applied to the polarization produced by the beamsplitter sweep of FIG. 7A, according to aspects of the invention.

FIGS. 6A and 6B illustrate a sequence of two concatenated sweeps which taken together will be referred to as a mirror sweep. A mirror sweep is analogous to a paired combination of the beamsplitter and combiner, or inverse of the beamsplitter, discussed above. FIG. 6A illustrates application of an effective drive field 110 initially in a polar orientation, to a polarization 120 oriented in the equatorial plane at an angle $\theta$ with respect to the axis of rotation of the drive field. The drive field rotates into the equatorial plane. The polarization precesses about the drive field at a rate proportional to the drive field strength, and ends up in the plane normal to the drive field and containing the drive field rotation axis (i.e., the beamsplitter sweep). The orientation of the polarization 120 in that plane is determined by the effective drive field strength and the duration of the sweep. The phase of the drive field 110 is then incremented by $\pi$, as depicted in FIG. 6B, and swept back to its original polar orientation. The field strength and sweep duration are substantially the same as those used in the first sweep. The polarization thus precesses through the same angle about the drive field 110 as during the first sweep, but in the opposite sense, so that its final orientation is in the equatorial plane at the angle $\theta$ with respect to the axis of orientation as shown (i.e., the phase reversal combiner sweep). Thus, the polarization 120 has been "mirrored" in the equatorial plane with respect to the polarization axis of rotation.

In certain instances, use of a far off resonant laser source for the tipping field permits implementation of either a mirror sweep or a standard Raman mirror pulse in interferometer applications. There is presently no mechanism for implementing a mirror function with STRAP, and as a result, STRAP-only interferometers realize reduced interferometer contrast as compared to RCAP or Raman-based interferometers.

According to various aspects, Raman ARP has greatly reduced sensitivity to off-resonant drive fields compared to Raman $\pi/2$ pulses. For example, if the field in FIG. 2 were off-resonance, the first pulse would leave $\hat{p}$ above or below the x-y plane, but its phase would be unaffected. Applying the second pulse at a relative phase of $\pi/2$ (such as is done in clock operation), the resulting population difference error from Raman detuning is second order in $\delta/\Omega_{gen}$, and not first order as would be the Raman pulses. Thus, the AC Stark shift (which is an important cause of off-resonant drive field errors) can be essentially eliminated as a clock error source. This is further shown in the examples discussed below, where AC Stark shifts of a range of values were deliberately imposed, and the resulting interferometer phases were recorded for both Raman pulse and Raman ARP based Ramsey interrogations.

Figure 7:
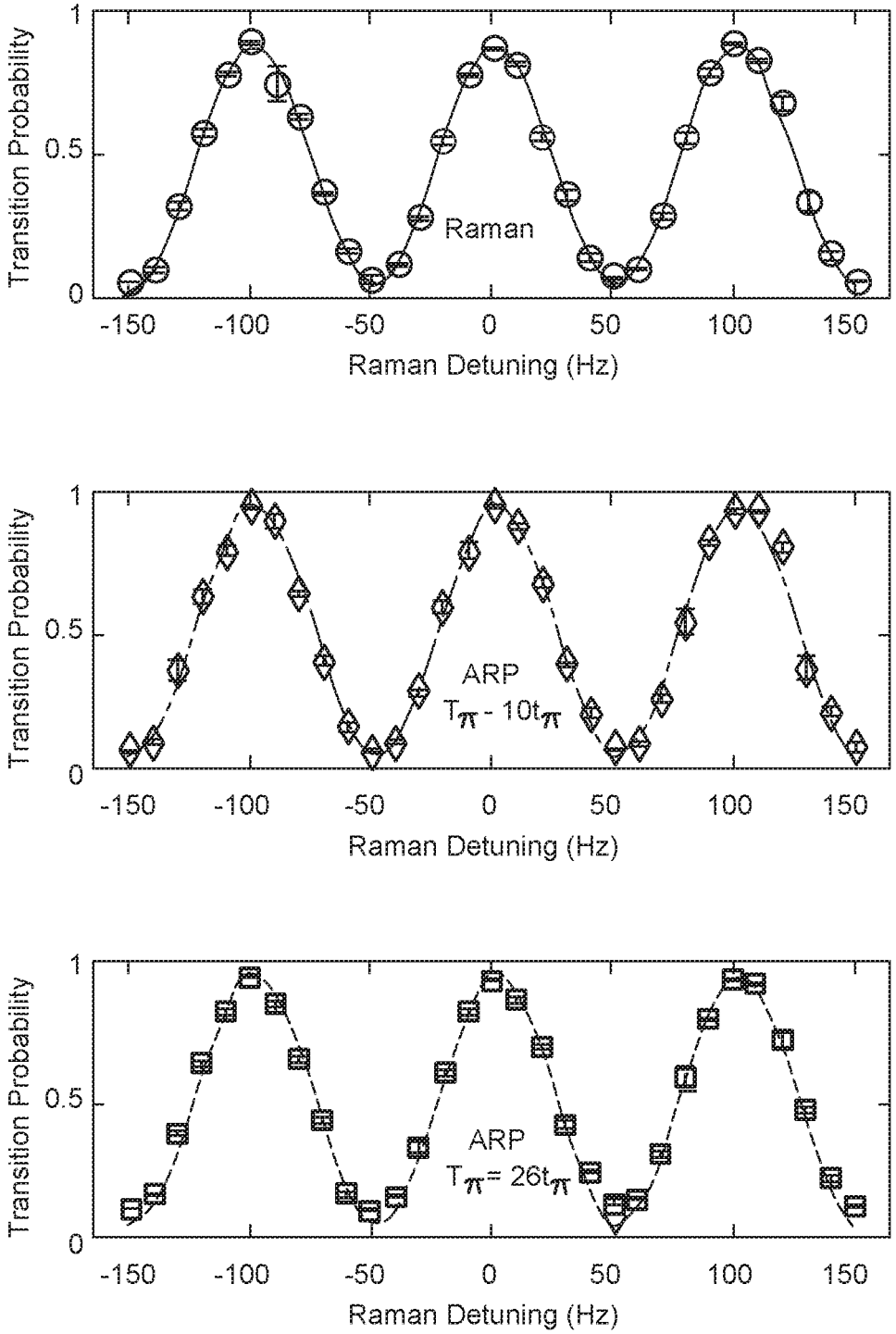
FIG. 7 is a series of graphs illustrating examples of Ramsey fringes based on Raman π/2 pulses and Raman ARP beamsplitters with two different sweep durations.

Referring back to FIG. 2, rapid completion of the pulse sequence depicted in parts (a)-(d) may be beneficial for a device operating in a dynamic environment. A short measurement sequence ensures that an atom cloud experiencing large transverse acceleration forces remains within the Raman laser beam during the Ramsey interrogation. It also enables averaging of noise processes to lower levels in shorter times, which enhances short-term sensitivity. For example, an interrogation time of T=10 ms, coupled with a sampling rate of $f_S$=80 Hz, and a phase signal-to-noise ratio of $SNR_\phi$=200, results in a fractional frequency stability as expressed below by Equation (3):

$$\frac{1/SNR\phi}{\omega_{HFS}T\sqrt{f_s}} \qquad \text{Equation (3)}$$

having a value of $\approx 1\times10^{-12}$ for an averaging time of 1 s. In addition, the cloud remains within the $1/e^2$ intensity radius of the Raman beam for transverse accelerations up to 5 g. FIG. 7 shows examples of Ramsey fringes based on Raman $\pi/2$ pulses and Raman ARP beamsplitters with $T_\pi=10t_\pi$ and $26t_\pi$, where $t_\pi=\pi/\Omega_{eff}$ is the duration of a resonant Raman $\pi$ pulse. The results shown in FIG. 7 used an experimental set-up as discussed further below. The interrogation time T was 10 ms, the magnitude of the two-photon Rabi rate was $\Omega_{eff}/2\pi$=73 kHz, and the ARP sweep parameters were $\delta_{max}/2\pi$=15 MHz and $\Omega_{arp}/2\pi$=73 kHz. To reduce discrepancies arising from oscillator drifts and environmental magnetic fields, the three pulse types were applied sequentially at a given detuning, and measurements were collected at 1.6 Hz over 10 min. The measurements were fit to a cosine function according to Equation (4) below:

$$P = \frac{1}{2} + \frac{A}{2}\cos[(\delta - \delta_0)T] + B \qquad \text{Equation (4)}$$

where P is the measured transition probability, i.e., the normalized atom count, and free parameters such as contrast A, background offset B, and Raman detuning offset $\delta_0$, are determined through minimization of the sum of squares of the residuals. For both the Raman $\pi/2$ and $T_\pi=26t_\pi$ cases, the fit uncertainty in $\delta_0/2\pi$ was ±0.24 Hz, which indicated similar short-term stability.

EXAMPLES

The function and advantages of these and other embodiments will be more fully understood from the following examples. These examples are intended to be illustrative in nature and are not to be considered as limiting the scope of the systems and methods discussed herein. The following examples demonstrate atom interferometry with Raman chirped adiabatic passage sweeps using the apparatus described below.

Figure 8B:
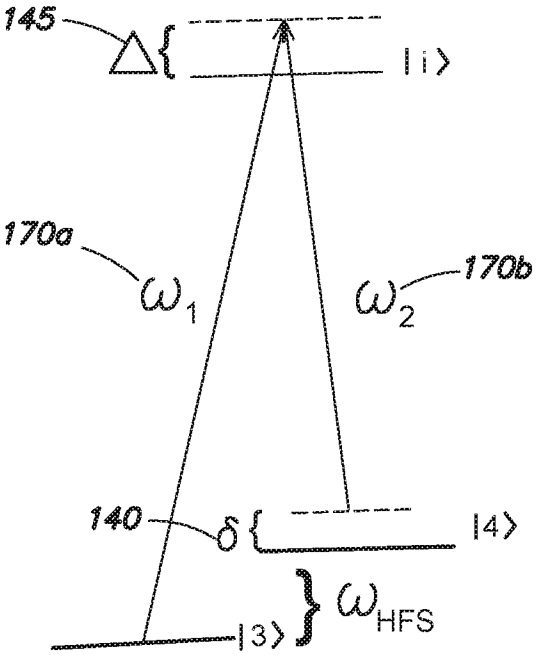
FIG. 8B is a diagram schematically illustrating the intermediate excited states for a stimulated Raman process according to aspects of the invention.
Figure 8A:
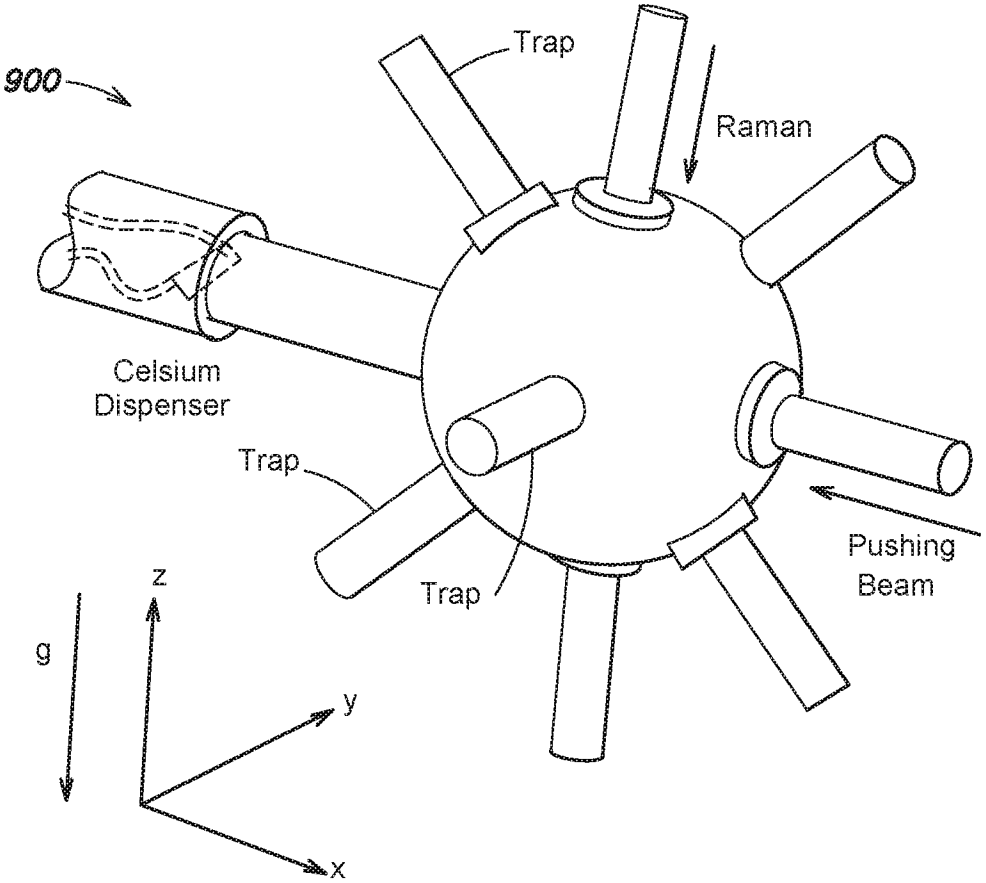
FIG. 8A is diagram schematically illustrating an octagonal glass vacuum chamber and laser beam configuration for atom trapping, state preparation, and interferometry according to aspects of the invention.

In particular, the interferometry experiments were conducted using D2 line cesium 133 atoms and were conducted inside an octagonal 80-$cm^3$ machined-quartz cell, having a diameter of 2.75 inches, such as the one shown at 800 in FIG. 8A, which maintained a background vapor pressure of approximately $10^{-9}$ Torr. During experiments, atoms fall through the center of the Raman beam because of its vertical orientation. Environmental magnetic fields were canceled by three orthogonal pairs of Helmholtz coils. Each measurement cycle began with the cooling and trapping of ~$10^7$ atoms in 600 ms using a magneto-optical trap (MOT). Polarization gradient cooling further cooled the cloud to 9 μK. To prepare the atoms in a single hyperfine ground state, a vertical bias field of 0.87 G was first applied to lift the Zeeman degeneracy. The atoms were then optically pumped on the $|F=4\rangle \rightarrow |F'=4\rangle$ transition (where F' denotes a hyperfine level in the $6^2P_{3/2}$ manifold) with light polarized linearly and parallel to the bias field until 90% of the atoms were in the $|F=4,m_F=0\rangle$ dark state. Light resonant with the $|F=3\rangle \rightarrow |F'=4)$ transition simultaneously pumped atoms out of F=3. A microwave $\pi$ pulse tuned to the clock transition transferred atoms from the dark state to $|F=3,m_F=0\rangle$. A subsequent laser pulse, resonant with the $|F=4\rangle \rightarrow |F'=5\rangle$ cycling transition, pushed atoms remaining in F=4 out of the interaction region. Interferometry began with >97% of the remaining atoms initially in the $|F=3,m_F=0)$ clock state. These atoms were interrogated in a Ramsey sequence, which comprised two atom "beamsplitters" (e.g., Raman $\pi/2$ pulses) separated by an interrogation time T that ranged from 1 to 17 ms. The final state of the interferometer consisted of atoms in superpositions of the F=3 and F=4 clock states. To extract the interferometer phase, the fraction of atoms in F=4 after laser induced fluorescence were measured. Specifically, light resonant with the $|F=4\rangle \rightarrow |F'5)$ transition was applied, and the resulting fluorescence was associated with states that had collapsed to F=4. A second pulse of the same light then pushed these atoms out of the interaction region. The remaining atoms in F=3 were optically pumped to F=4 and fluoresced in a similar manner. The sum of these two fluorescence signals was proportional to the total population and the ratio of total fluorescence to fluorescence from the F=4 atoms provided a normalized readout.

The cesium clock transition ($|F=3,m_F=0\rangle \rightarrow |F=4, m_F=0\rangle$) was driven using stimulated Raman processes via intermediate excited states in the $6^2P_{3/2}$ manifold, as shown in FIG. 8B. For example, cesium 133 atoms at ground-state levels $|3\rangle$ and $4\rangle$ are coupled by a stimulated Raman transition with single-photon detuning Δ 145, Raman detuning δ 140, and optical frequencies $\omega_1$ 170*a* and $\omega_2$ 170*b*. The Raman optical frequencies, $\omega_1$ and $\omega_2$ (170*a* and 170*b*), were generated by phase modulating the output of an external cavity diode laser (100 kHz linewidth, 50 mW) with an electro-optic modulator (EOM), i.e., a phase modulator. The optical spectrum contained frequency sidebands spaced about the carrier by integer multiples of the Zeeman-shifted hyperfine splitting frequency $\omega_{HFS}/2\pi$=9 192 631 770+324 Hz. To reduce spontaneous emission, the Raman laser was blue-detuned by 2.02 GHz with respect to the $|F=3\rangle \rightarrow |F'=4\rangle$ transition. At this detuning, the differential AC Stark shift (i.e., the difference of the AC Stark shifts of the clock states) was canceled when the optical power was ~10% larger in the carrier frequency than in each first-order sideband. To obtain agile control over the microwave signal that drove the EOM, a single-sideband mixer (Polyphase SSB90110A) was used to combine the 30-MHz output of a 625-MS/s arbitrary waveform generator (Agilent N8241A) with a constant 9.163-GHz signal (Agilent E8257D). The phase, frequency, and power of the resulting RF signal were controlled through the waveform generator, enabling rapid frequency sweeps for Raman ARP. An acousto-optic modulator placed before the EOM switched the Raman light in 50 ns, and a tapered amplifier downstream of the EOM increased the total Raman optical power presented to the atoms to 40 mW. The optical spectrum of the tapered amplifier contained a 30-nm-wide pedestal carrying a small amount of resonant light. To reduce spontaneous emission during the interferometer, the resonant light from the pedestal was filtered by passing the output of the tapered amplifier through a Cs reference vapor cell. The Raman beam was vertically oriented, circularly polarized, and delivered to the cell using a fiber-coupled collimator with 7.1-mm $1/e^2$ intensity diameter. The co-propagating pair of carrier and −1 sideband frequencies drove the dominant Raman transition, which was Doppler shifted by 30.7 Hz/(m/s), or 0.3 Hz/ms in a 1-g environment.

The interferometry experiments described below generally involved extracting interferograms while deliberately varying parameters like the differential AC Stark shift or the two-photon Rabi rate. To generate an interferograms, the transition probability was measured while shifting the laser phase difference between the Raman optical fields. This phase difference was scanned over 17 values in steps of $\pi/4$ rad, and the transition probability at each phase was measured five times consecutively to enable averaging. With a per-shot data rate of 1.6 Hz, a full interferograms was acquired every 53 s. To isolate slow systematic variations due to oscillator drift and environmental magnetic fields, interferograms for ARP, Raman, and microwave pulses were acquired consecutively, within 2.7 min, at a particular parameter setting. Parameters were varied nonmonotonically to further reduce contributions from slow systematic trends. Parameter values of interest were cycled through three times for additional averaging.

A cold atom frequency standard based on Ramsey sequences is likely to experience parameter fluctuations during operation outside the laboratory. In dynamic environments, variations in optical power, RF power, and atom cloud position may affect Ramsey interferograms. One or more of the examples discussed below demonstrate how Raman ARP beamsplitters in a Ramsey sequence suppress one or more of these effects.

Example 1: Light Shifts During a Pulse

A Ramsey sequence based on Raman ARP affords an important advantage of Raman $\pi/2$ pulses: light shifts experienced during a pulse leave the interferometer phase unperturbed. The presence of a light shift during Raman ARP moves the center frequency of the sweep off resonance. The beamsplitter shown in part (b) of FIG. 2 ends outside the x-y plane, as does the parallel pseudospin $\hat{p}$. This error in polar angle does not affect the phase of the Ramsey interferometer, which instead depends on the azimuthal separation between $\hat{p}$ and $\vec{\Omega}_{gen}$. Errors in polar angle, however, do affect interferometer contrast. When the second beamsplitter is initially $\pi$ rad out of phase with $\hat{p}$, the light shift reduces the transfer efficiency, causing the troughs of the interferograms to rise up. In certain applications where small light shifts are relevant, the resulting variations in contrast and background offset have a minor impact on sensitivity, as discussed further below.

The sensitivity of three types of Ramsey sequences to the differential AC Stark shift $\delta_{ac}$ were tested: (1) Raman $\pi/2$ pulse sequences, (2) Raman ARP sequences with a sweep duration $T_\pi$ of $10t_\pi$, and (3) Raman ARP sequences with a sweep duration of $26t_\pi$. The contrast A, background offset B, and systematic phase offset $\Phi$ for each interferogram were recorded. The transition probability P is related to these quantities by Equation (5) above, where the detuning dependence in the argument of the cosine function is replaced by $\Phi+\Delta\varphi$, and $\Delta\varphi$ is the programmed phase difference between the two Ramsey pulses. Entire interferograms were extracted to determine A, B, and $\Phi$ simultaneously, which suppressed undesirable cross-coupling effects in the measurement of P. This technique differs from another, simpler approach in which each measurement of phase is related to a single measurement of transition probability made with $\Delta\varphi=\pi/2$ and $\Phi\neq0$. In this latter approach, phase measurements are susceptible to variations in A and B since the transition probability varies with these parameters, i.e., see Equation (4).

For each AC Stark shift setting, the three types of interferometers were measured sequentially, three times over 8 minutes. To extract an interferogram, $\Delta\varphi$ was scanned over two fringes in steps of $\pi/4$ rad, and to enable averaging, each phase condition was repeated five consecutive times. The AC Stark shift was varied by adjusting the relative optical power in the two Raman frequency components. This meant that the AC Stark shift was controlled with the modulation depth of the electro-optic modulator (EOM) in the Raman beam path, which in turn adjusted the ratio of the optical powers in each Raman frequency. In essence, the light shift $\delta_{ac}$ was deliberately varied by changing the ratio of optical powers in each Raman frequency. At each setting of the modulation depth, the overall optical power was adjusted with the tapered amplifier to maintain $\Omega_{eff}/2\pi$=73 kHz to within ±2%. The light shift was assumed to be the Raman detuning at which population transfer with a Raman $\pi$ pulse was maximized. These calibration steps were followed by setting the oscillator frequency to the Zeeman-shifted clock resonance before interferometry commenced. Thus, the oscillator was detuned by the light shift during application of the pulse, but resonant with the atoms during the Ramsey dwell period. The short interrogation time T=1 ms suppressed the sensitivity to oscillator instabilities and helped isolate phase shifts associated with pulse dynamics.

Figure 9A:
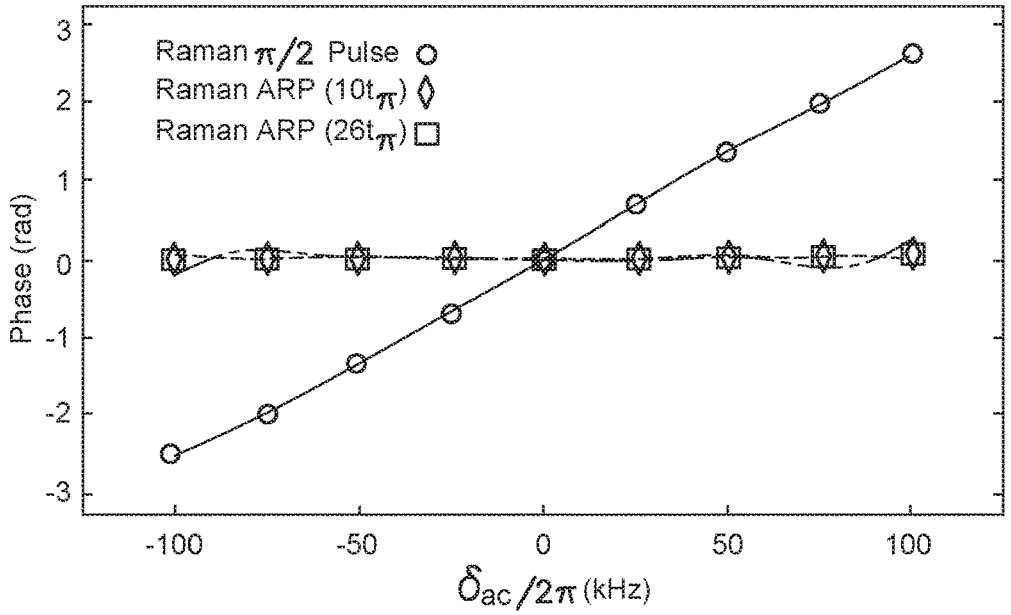
FIGS. 9A-9C are a series of graphs illustrating a series of measurements of two-pulse Ramsey sequence phase shifts for Raman pulse and ARP interrogations according to aspects of the invention.

FIG. 9A is a plot of the overall systemic phase offset $\Phi$ of each interferometer as a function of $\delta_{ac}$. The Raman $\pi/2$ pulse measurements show good agreement with the predictions from the Bloch model discussed above, reflecting an approximately linear transfer function over a range in AC Stark shifts of ±100 kHz with a slope of 26 mrad/kHz, which corresponds to the light shift sensitivity. The ARP interferometers strongly suppress this sensitivity. The results indicate that the Raman-pulse case was about 75 times more sensitive to $\delta_{ac}$ than the Raman ARP interrogations having sweep durations of $10t_\pi$ and $26t_\pi$.

Figure 9B:
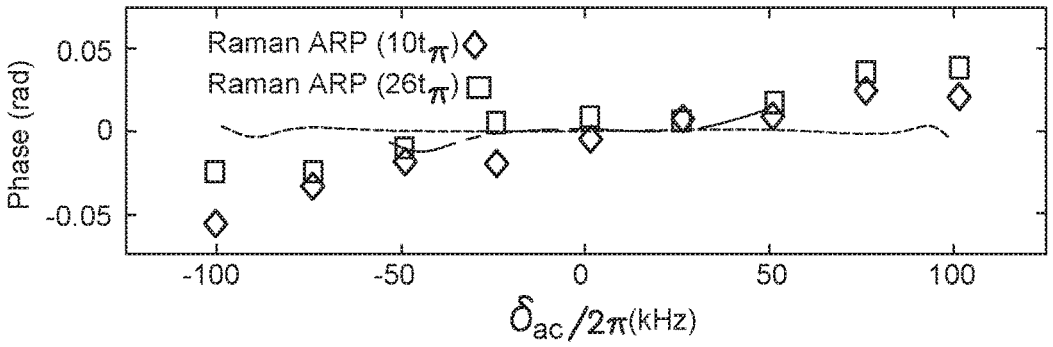

A more detailed view of the Raman ARP interrogations is shown in FIG. 9B, which plots the AC Stark induced shifts for the ARP modalities over a ±100 kHz variation of AC Stark shift. Since the ARP modalities show little phase response to AC Stark shift, a much smaller range of phases must be shown in order to present the measured phase shifts. FIG. 9B indicates an overall linear trend of 0.34 mrad/kHz, with localized curvature, neither of which the Bloch model discussed above predicts. The predictions for $T_\pi=10t\pi$ are restricted to detunings where the sweep is adiabatic enough for the model to produce controlled phase shifts. The corresponding measured phases at $\delta_{ac}/2\pi=\pm100$ kHz are not completely randomized, which may be a result of ensemble averaging effects.

Figure 9C:
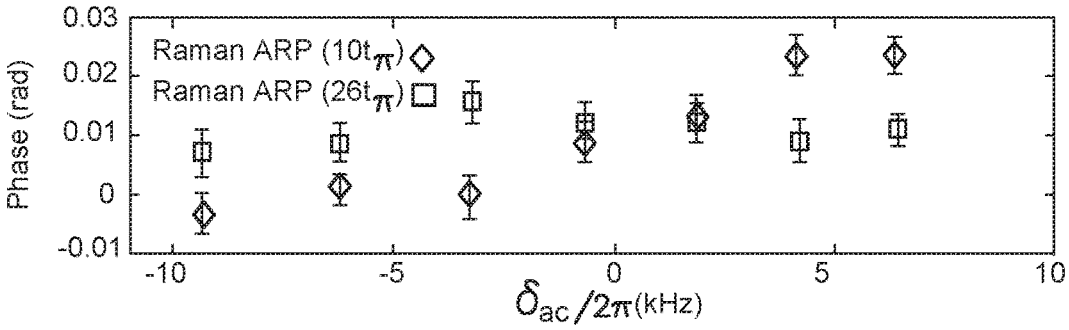

The differential Stark shift with $\Delta\neq2$ GHz in practice may be restricted to $\pm0.02\Omega_{eff}\neq\pm2\pi\times1$ KHz, due to ~1% power fluctuations in the RF signal modulating the EOM. Below this bound, the measurements and stabilization of RF power may be difficult to obtain. Thus, the experiment was repeated over a narrower detuning range near $\delta ac=0$. In this example, $\Omega_{eff}$ was not calibrated from one condition to the next, because the measured variation was ±2% of the nominal setting. The light shift was calibrated to the modulation depth of the EOM, which was then tracked via real-time RF power measurements. Linear fits to the Raman ARP phase offsets are shown in FIG. 9C, and the Raman phase offsets (not shown) were compared to determine the relative sensitivity to $\delta_{ac}$. FIG. 9C shows that AC Stark shift induced phases are limited to a total range of about 10 mrad (26 mrad) for ARP $10t_\pi$ (ARP $26t_\pi$) sweep regimens in a ±10 kHz variation of AC Stark shift. The ratios of the two ARP slopes to the Raman slope were 0.063±0.008 for the $10t_\pi$ case and 0.0005±0.008 for the $26t_\pi$ case. Drifts in $\delta_{ac}$ on the order of $\pm0.02\ \Omega_{eff}$ are expected in a practical device, so the measured sensitivity of the Raman $\pi/2$ sequence to $\delta_{ac}$ implies that the phase will drift by 26 mrad. In the case were $\delta_{ac}$ is a white noise process, the fractional frequency stability for the example presented in Equation (4) becomes $5\times10^{-12}$ after 1 s of averaging, because the phase signal-to-noise ratio drops to $SNR_\phi=40$. By comparison, the Raman ARP interferometer with a sweep duration of $26t\pi$ brings the noise process due to AC Stark shifts below the atom shot noise limit for $10^7$ atoms. Thus, the results in FIG. 9C indicate that the Raman pulse case was roughly 100 times more sensitive to $\delta_{ac}$ than Raman ARP interrogations with $T_\pi=26t_\pi$. Notably, the simple Bloch model fails to predict the AC Stark induced shifts; further at least part of the variation may be stochastic, given that the measurements were taken over a period of several hours. According to various aspects, it can be estimated from these measurements that the use of ARP affords a ~100× reduction in sensitivity to AC Stark shift, reducing the requirement for AC Stark shift control to the ~few hundred Hz level in order to achieve good (<1e-13) long-term stability.

Example 2: Comparative Stability

Figure 10:
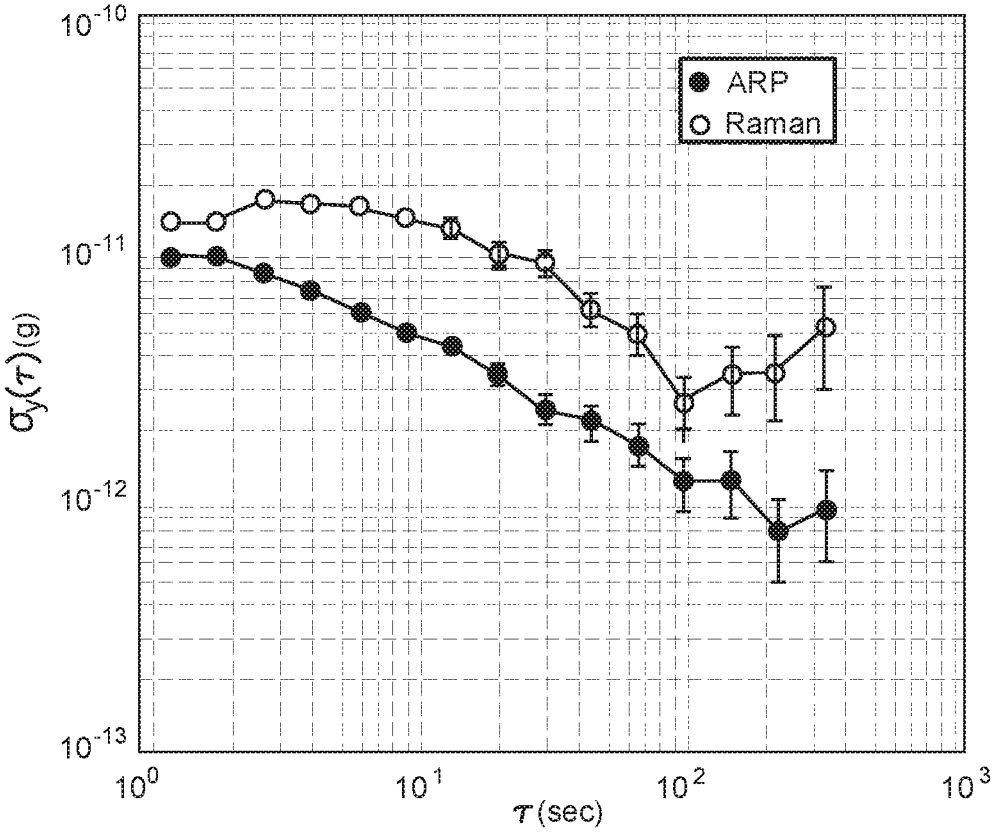
FIG. 10 is a graph illustrating the comparative stability of Raman and ARP clocks under nominally identical operating conditions according to aspects of the invention.

Experiments were also conducted that illustrate the comparative effect of a stochastic AC Stark shift on relative clock stability. FIG. 10 shows Allan deviation plots of fractional open loop clock stability vs. measurement interval, for Raman pulse and ARP sweep based open loop clock measurements. By "open loop clock" operation, it is meant that the interferometers were operated with a $\pi/2$ phase shift applied to the second pulse, which results in the population transfer taking on a value near to the interferogram mean value. Deviations from the interferogram mean value can then be interpreted as a phase shift. Changes in median transfer would also register as apparent phase shifts in the measurements of FIG. 10.

The measurements of FIG. 10 were "interleaved," in the sense that measurements were acquired at a total rate of about 1.8 Hz, alternating between Raman and ARP interrogations. This regimen was adopted so that the two modalities would be subjected to [nearly the] same long term drift effects, permitting comparison of stability under nominally identical operating conditions. Thus, alternate data corresponding to a given modality were analyzed as single streams of data acquired at 0.89 Hz. The measurements were taken over a period of about 1 hr; the Rabi rate was $\Omega_{eff}/2\pi=88$ kHz; and the measurement time was T=16.6 msec. Measured interferometer contrast (peak-to-trough variation in population transfer) was >80% for both modalities. It is noted that the ARP clock stability was substantially better than that of the Raman clock, with the Raman clock exhibiting a minimum Allan deviation of 3e-12 at $\tau=100$ s and trending up thereafter. The ARP clock achieved a minimum Allan deviation of 8e-13 at $\tau=200$ seconds and might have started an upward trend at $\tau=300$ sec. Subsequent measurements (not shown) taken in a similar manner as those performed for FIG. 10 show a strong correlation between AC Stark shift and Raman phase variation. Without being bound by theory, it is believed that the difference in clock stability between Raman and ARP interrogation may be due to variation in AC Stark shift.

The results of FIG. 10 indicate that the absolute fractional stability at short times is better than typical cold atom based clocks. This is despite the fact that the clock used in these experiments was operating at an extremely low repetition rate. Higher repetition rates may also be used for high contrast Raman interferometry application with, e.g., a 16 msec interrogation time and 40 Hz repetition rate (an 80% duty cycle). The short-term stability may improve to a level below the stability of the reference timebase (5e-12) used herein. In addition, minor improvements to the interrogation method may afford a significant long term stability improvement: while it has been shown that interferometer phase variation due to AC Stark shift is small, it has also been observed that the mean population transfer in ARP interrogation may be affected by AC Stark shift. Thus, instead of using a single $\pi/2$ phase shift on the second pulse of each interrogation, various aspects are directed to alternating between $\pm\pi/2$ and interpreting the difference between two sequential population transfer measurements as proportional to a clock phase change. This would subtract off the effects of slow drifts in mean transfer (as opposed to actual phase variations).

The examples discussed above relate to Raman pulse timekeeping with ARP. The examples discussed below are directed to large momentum transfer (LMT) Raman pulse interferometry with ARP. Specifically, experiments were performed that applied ARP sweeps to acceleration measurement based on LMT Raman interferometry. As discussed above, LMT Raman interferometry may be used for enhancing the sensitivity of inertial measurement through the use of pulses additional to the simple 3-pulse sequence first used for acceleration measurement. These additional pulses, which are referred to herein "augmentation pulses," serve to increase the sensitivity of Raman pulse interferometry by increasing the photon-induced spatial separation of the interfering wavepackets. The utility of sensitivity enhancement may be particularly apparent in dynamic environment sensing, wherein interrogation times T are necessarily limited by inertially induced cloud motion, while inertial measurement sensitivity (either rotation or acceleration) scales proportionally to $T^2$. High repetition rates enabled by atom recapture have been shown to achieve <μg level acceleration measurement using short interrogation times of <8 msec. LMT offers another means of restoring some of the sensitivity lost as a consequence of reduced interrogation time. According to various aspects, a high contrast LMT interferometry method is disclosed that uses atoms at relatively high atom cloud temperatures that is also compatible with high efficiency atom recapture, and thus operates at high repetition rates.

High contrast Raman atom interferometry acceleration sensing may be achieved with 9 μK atoms that includes exhibition of 4% contrast in an interferometer imparting 30 $\hbar$k momentum separation between interferometer arms. Typical demonstrations of LMT employ either ultracold atoms (tens of nano-K) or atom clouds with reduced effective temperature along the direction of the Raman beam (~500 nano-K).

Figure 11:
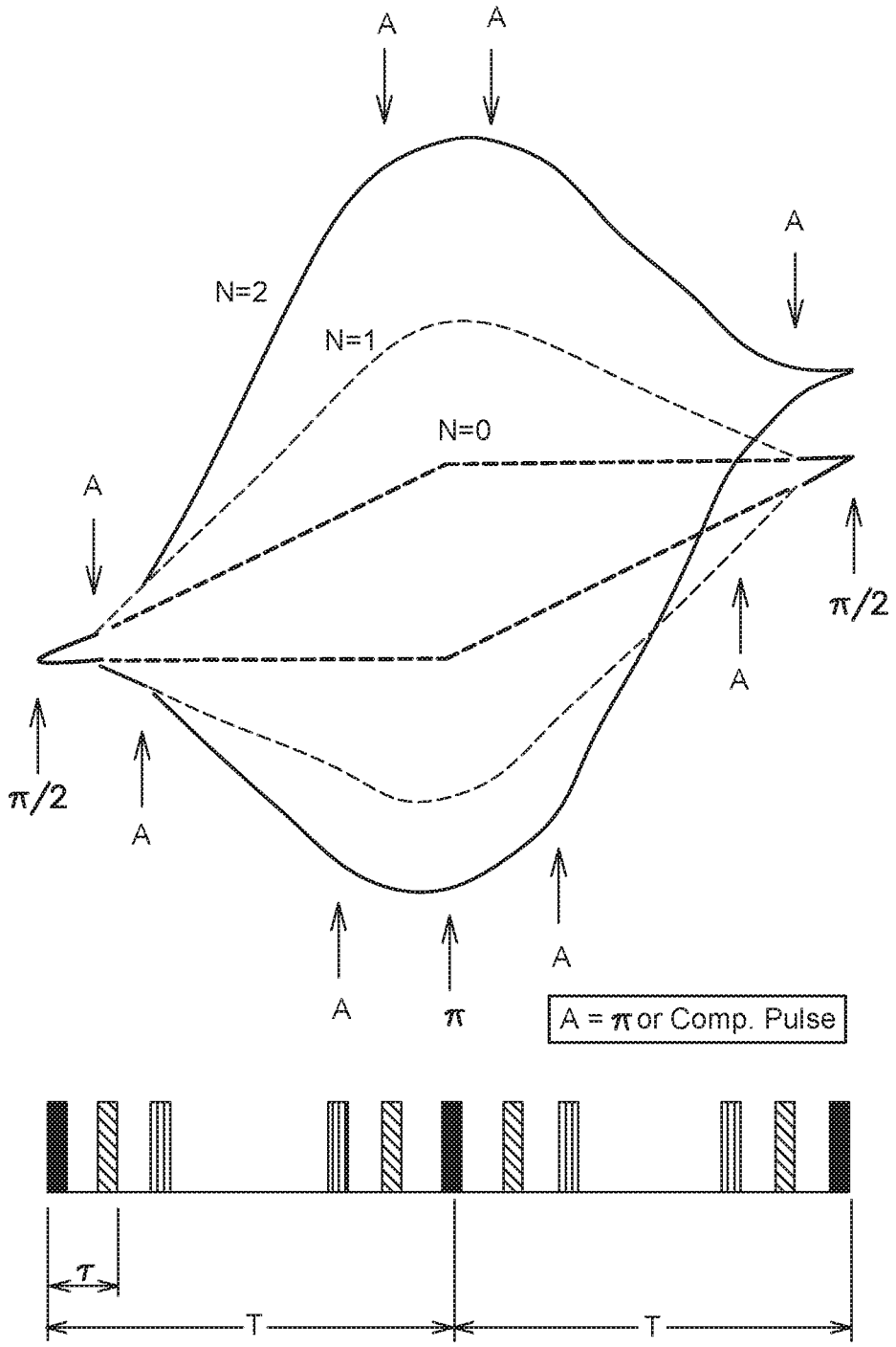
FIG. 11 is a space-time diagram of two large area interferometers and a conventional interferometer according to aspects of the invention.

FIG. 11 is a space-time diagram that presents examples of use of augmentation events to increase interferometer sensitivity and is featured in *Efficient broadband Raman pulses for large-area atom interferometry*, J. Opt. Soc. Am. B, Vol. 30, Issue 4, pp. 922-927 (2013). The two large area interferometers (N=1, 2) are shown with a conventional π/2–π–π/2 (N=0) interferometer. Augmentation pulses are denoted by an "A" and are Raman pulses, composite pulses, or ARP sweeps. The mirror sequence comprises N augmentation pulses before and after the mirror π pulse in order to achieve loop closure. For example, additional momentum is transferred by inserting Raman events (Raman pulses, so-called "composite pulses," or ARP sweeps) with alternating propagation directions $\vec{k}_{eff}$. For such an interferometer sequence to have useful contrast with ~10 μK atoms, the augmentation events must achieve high transfer efficiency over a wide range (many tens of kHz) of detunings.

As defined herein, LMT order N is the number of augmentation events used to "open" and "close" the space time diagram, as shown in FIG. 11. 4N augmentation pulses are added to an interferometer of LMT order N, and the momentum separation between upper and lower interferometer "arms" is (4N+2)$\hbar$k.

Example 3: Contrast vs. LMT Order

Figure 12:
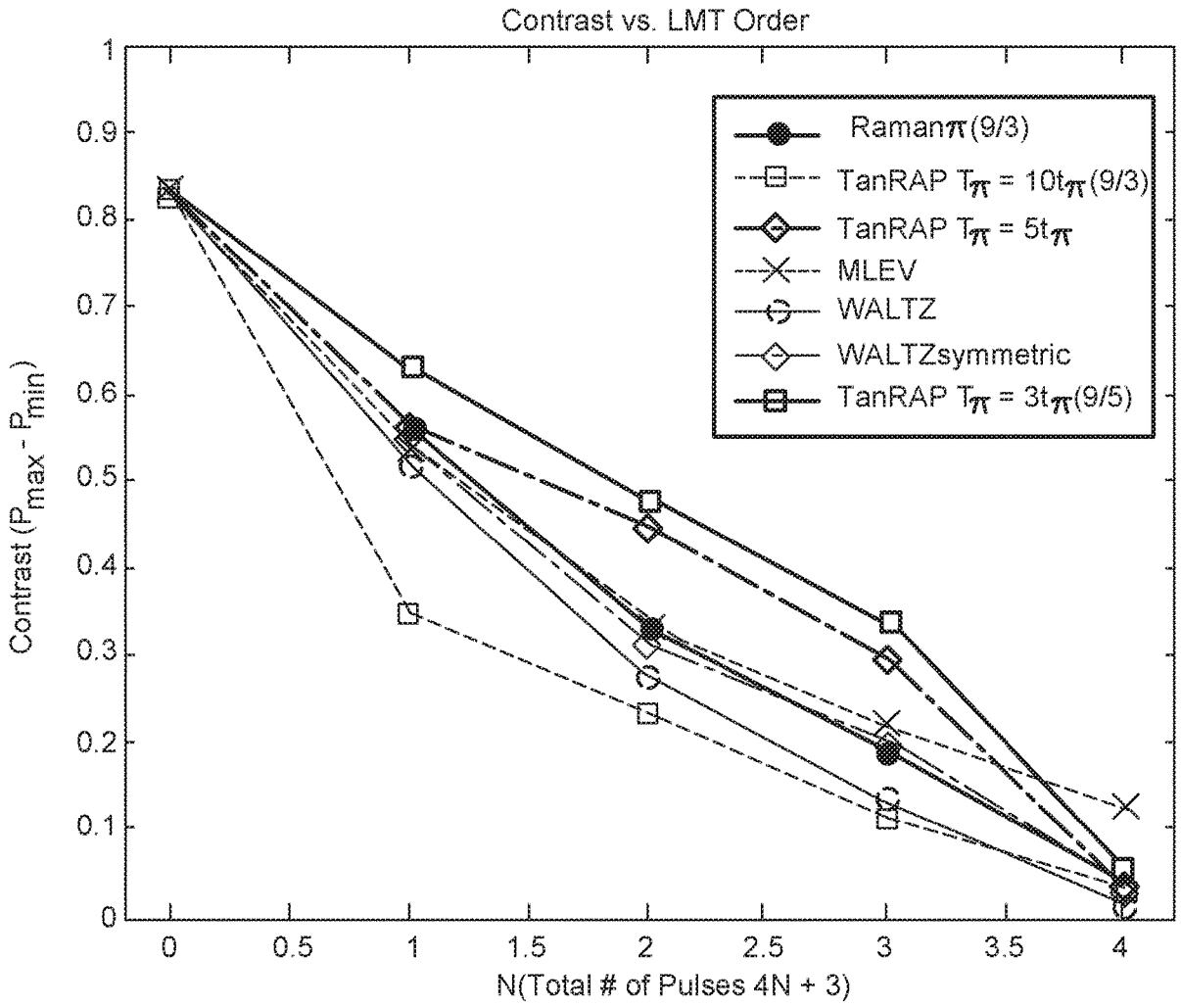
FIG. 12 is a graph illustrating the contrast response for a variety of augmentation pulse modalities according to aspects of the invention.

FIG. 12 displays the results from a series of measurements that were performed comparing the interferometer contrast of a variety of augmentation pulse modalities with the same interrogation time T, for a series of values of LMT order N. Seven different modalities are compared: Raman pulse, ARP sweep $T_\pi=10t_\pi$, ARP sweep $T_\pi=5t_\pi$, MLEV (composite pulse), WALTZ (composite pulse), WALTZ symmetric (composite pulse with time reversal symmetric space time diagram), and ARP sweep $T_\pi=3t_\pi$. The interrogation time was kept short (T=1 msec) to minimize the detrimental effects of vibrational acceleration noise.

Figure 13:
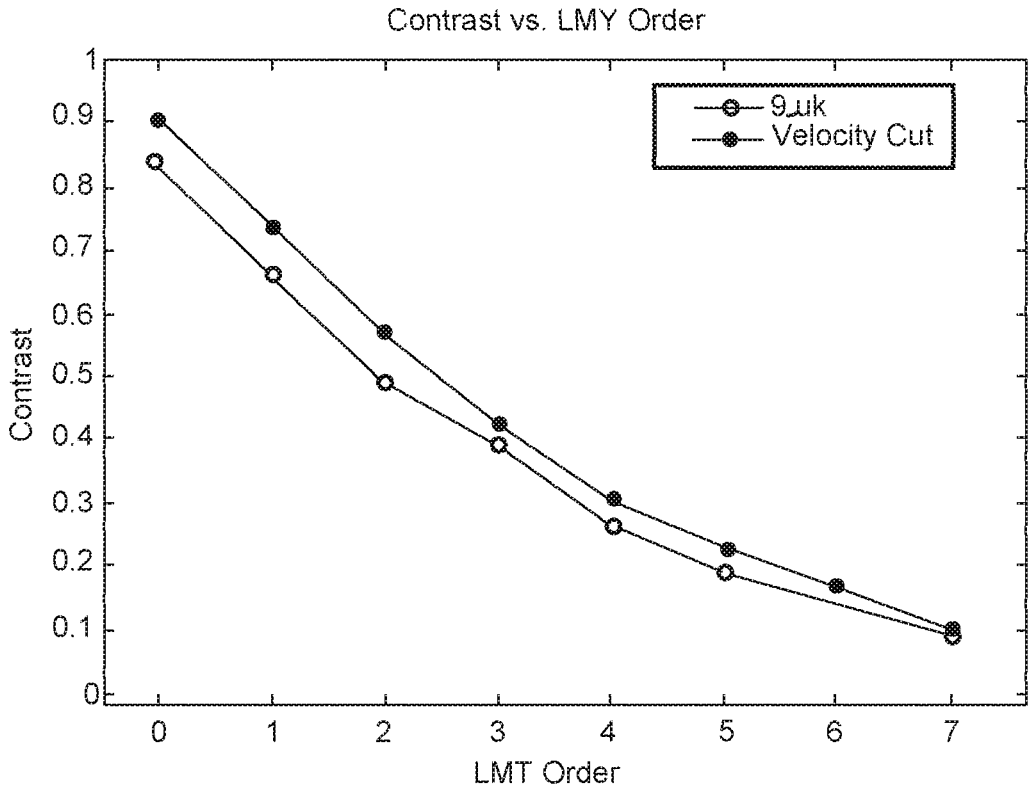
FIG. 13 is a graph illustrating contrast response versus large momentum transfer (LMT) order according to aspects of the invention.

The results indicate that the combination of ARP sweeps with the use of high Rabi rate (250 kHz for these experiments) and relatively large Raman beam diameter (7 mm $1/e^2$ diameter) afforded efficient population transfer with 9 μK (atom clouds. For example, referring to FIG. 12, the $T_\pi=3t_\pi$ ARP augmentation event yields comparatively better contrast than any of the other modalities tested. Further exploration of that LMT implementation was thus further conducted. FIG. 13 is a plot of measured contrast vs. LMT order for the $T_\pi=3t_\pi$ ARP augmentation event in a T=1 msec interferometer. The results show measurements for "hot" atoms (9 μK) and clouds from which narrow velocity cuts (effective temperature=0.5 μK) were extracted. Notably, there is only a modest difference between the two cases at T=1 msec, and therefore "hot" and velocity-cut atom clouds have very similar contrast profiles for the high Rabi rates used in these experiments. Results (not shown) also indicate that a 10% contrast is observed at N=7 (momentum separation of 30 $\hbar$k).

Example 4: $T_\pi=3t_\pi$ ARP Augmentation Event

Figure 14:
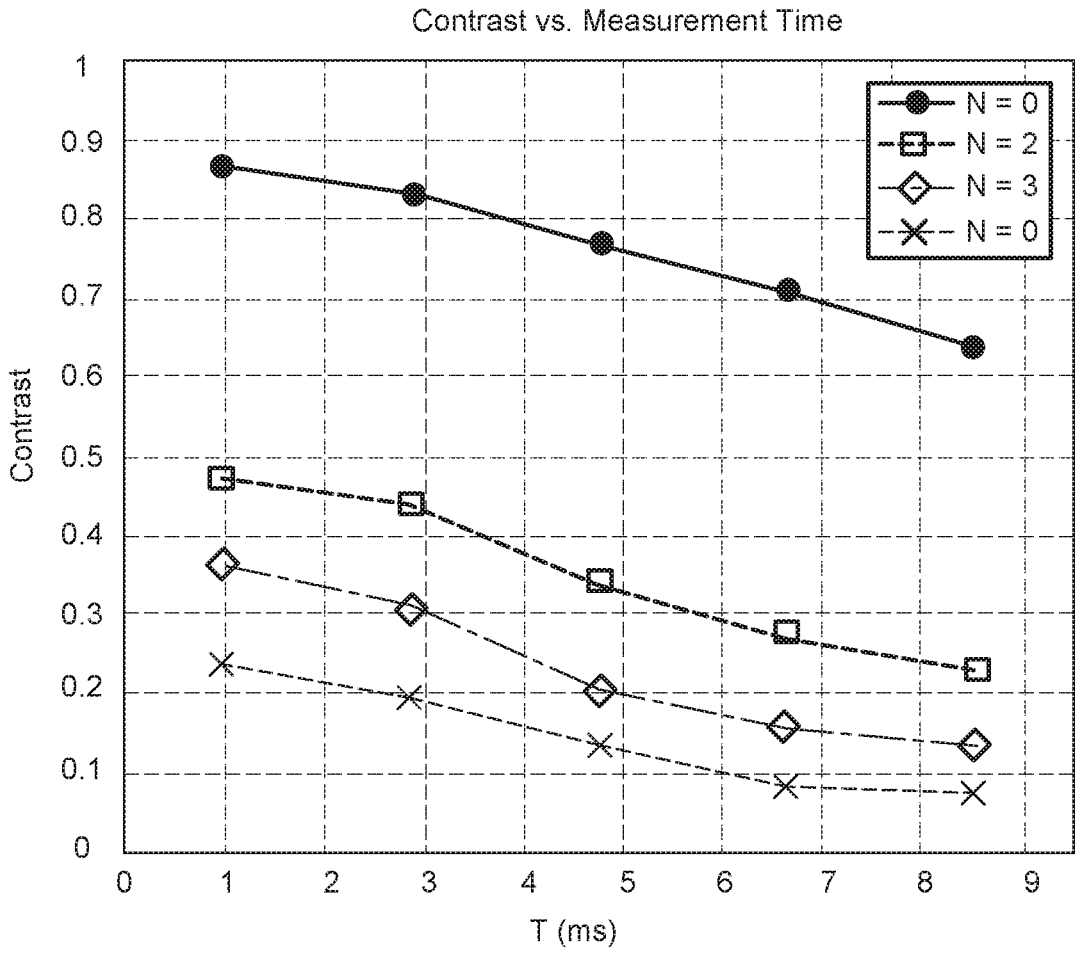
FIG. 14 is a graph illustrating contrast response as a function of measurement time according to aspects of the invention.

Though good contrast was observed at T=1 msec, contrast at longer interrogation times was also assessed. FIG. 14 displays measured interferometer contrast as a function of measurement time T for LMT orders 0-4. Even though contrast decreases with measurement time, the inertial sensitivity is increasing as $T^2$. At the longer dwell times, contrast was determined by considering the population transfer as being induced by a stochastic acceleration noise process. Thus, the population transfer data was analyzed according to a population transfer distribution function that would be produced in the presence of noise. The data of FIG. 14 may be interpreted in terms of net inertial sensitivity: for acceleration measurement, e.g., the short term acceleration noise density (in units of acceleration per sqrt(Hz)) is given by Equation (5) below:

$$\delta a = \frac{\delta\varphi_1}{C\cdot(2N+1)k_{eff}T^2\sqrt{f_r}} \qquad \text{Equation (5)}$$

where

C is the interferometer contrast, $\delta\varphi_1$ is the measured phase noise per shot in radians, and $f_r$ is the repetition frequency (rate at which acceleration measurements are executed, in Hz).

An acceleration sensitivity parameter may be defined as shown below by Equation (6):

$$C\cdot(2N+1)k_{eff}T^2 \qquad \text{Equation (6):}$$

Figure 15:
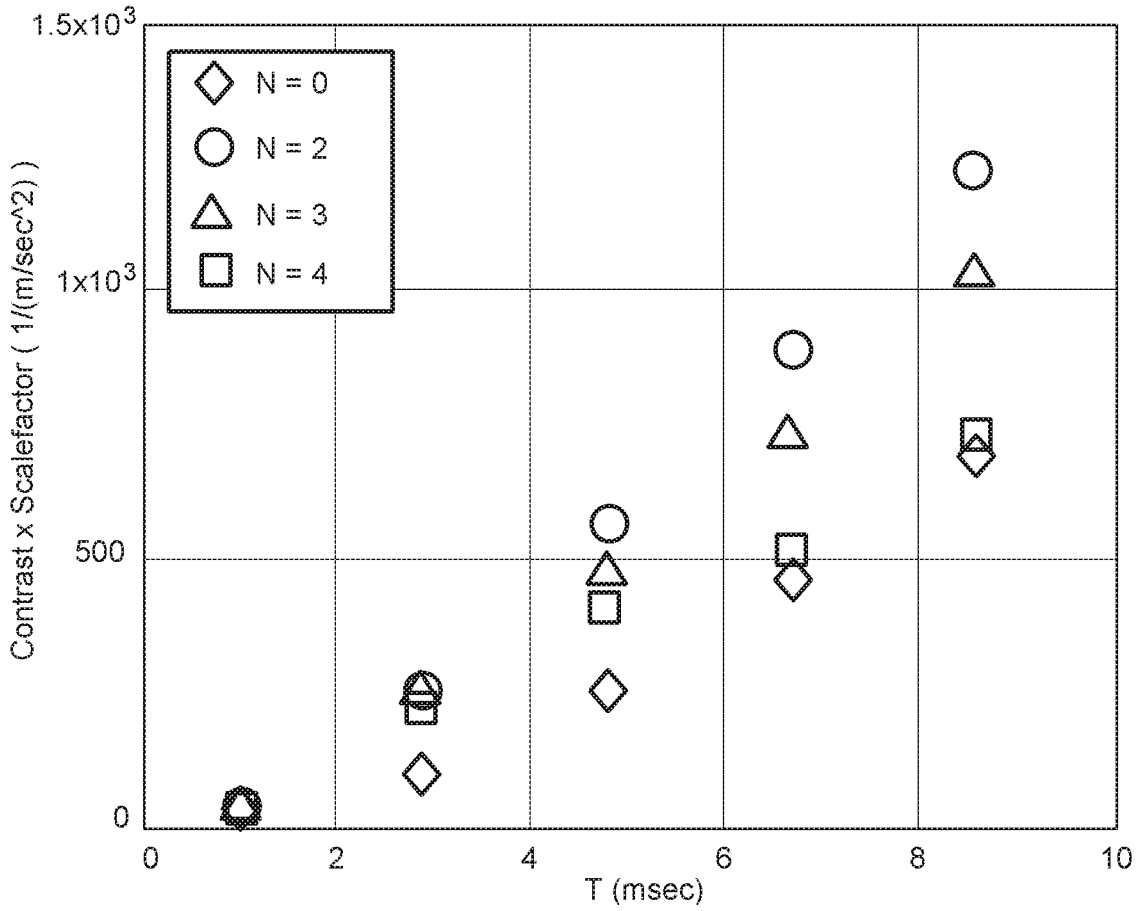
FIG. 15 is a graph illustrating an acceleration sensitivity parameter for the data of FIG. 14 as a function of measurement time in accordance with aspects of the invention.

The acceleration sensitivity parameter is plotted in FIG. 15 for the data of FIG. 14.

FIG. 15 shows that the highest sensitivity should be realized with LMT order N=2, and that for the LMT systems discussed herein, sensitivity increased approximately linearly with measurement time T. Notably, the effective sensitivity of LMT order N=2 is between 2 and 2.8 times larger than that for N=0.

The measured phase change per unit applied acceleration, i.e., the "scalefactor" may be expressed Equation (7) below:

$$\text{scalefactor}=(2N+1)k_{eff}T^2 \qquad \text{Equation (2):}$$

Figure 16:
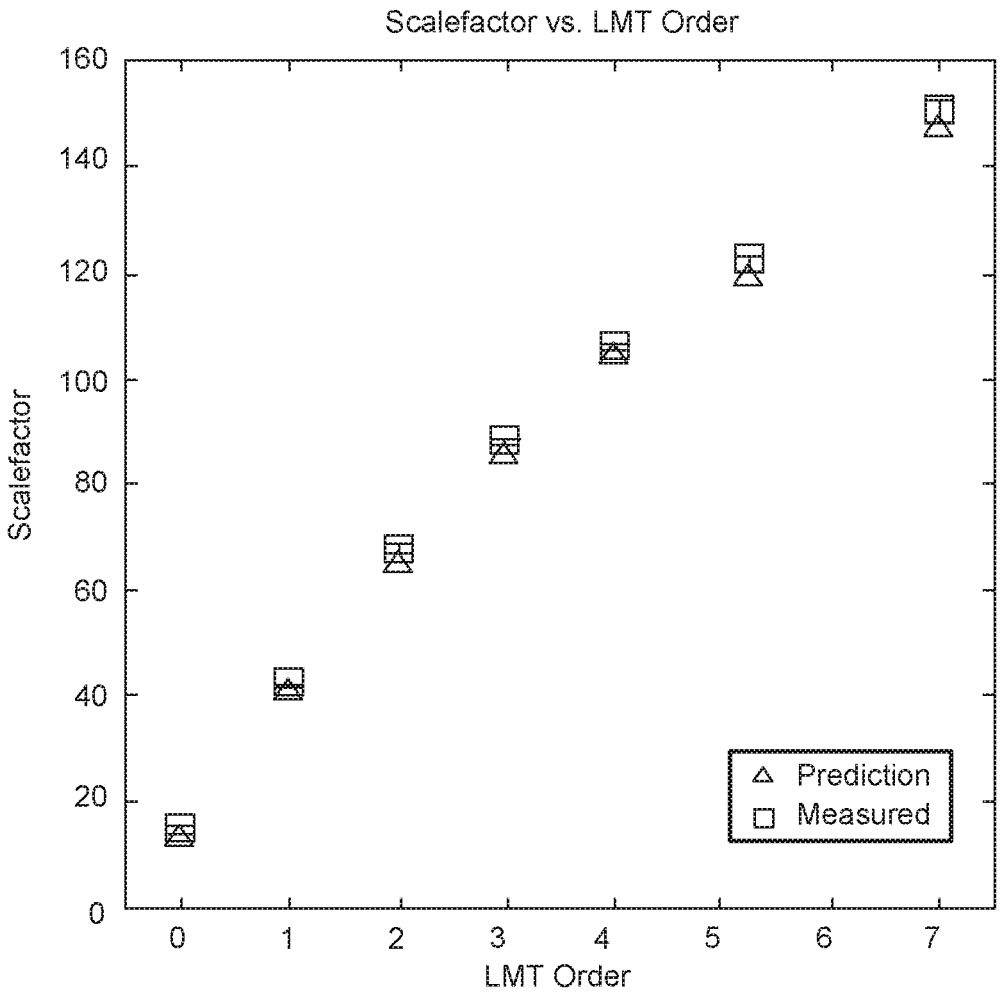
FIG. 16 is a graph illustrating the measured phase change per unit applied acceleration for various LMT orders according to aspects of the invention.

FIG. 16 is a plot of the scalefactor, as deduced by varying the Raman frequency chirp rate acceleration compensation, for various LMT orders using $T_\pi=3t_\pi$ ARP augmentation, with T=1 msec. The results indicate good agreement with the predicted values for the scalefactor.

Figure 17:
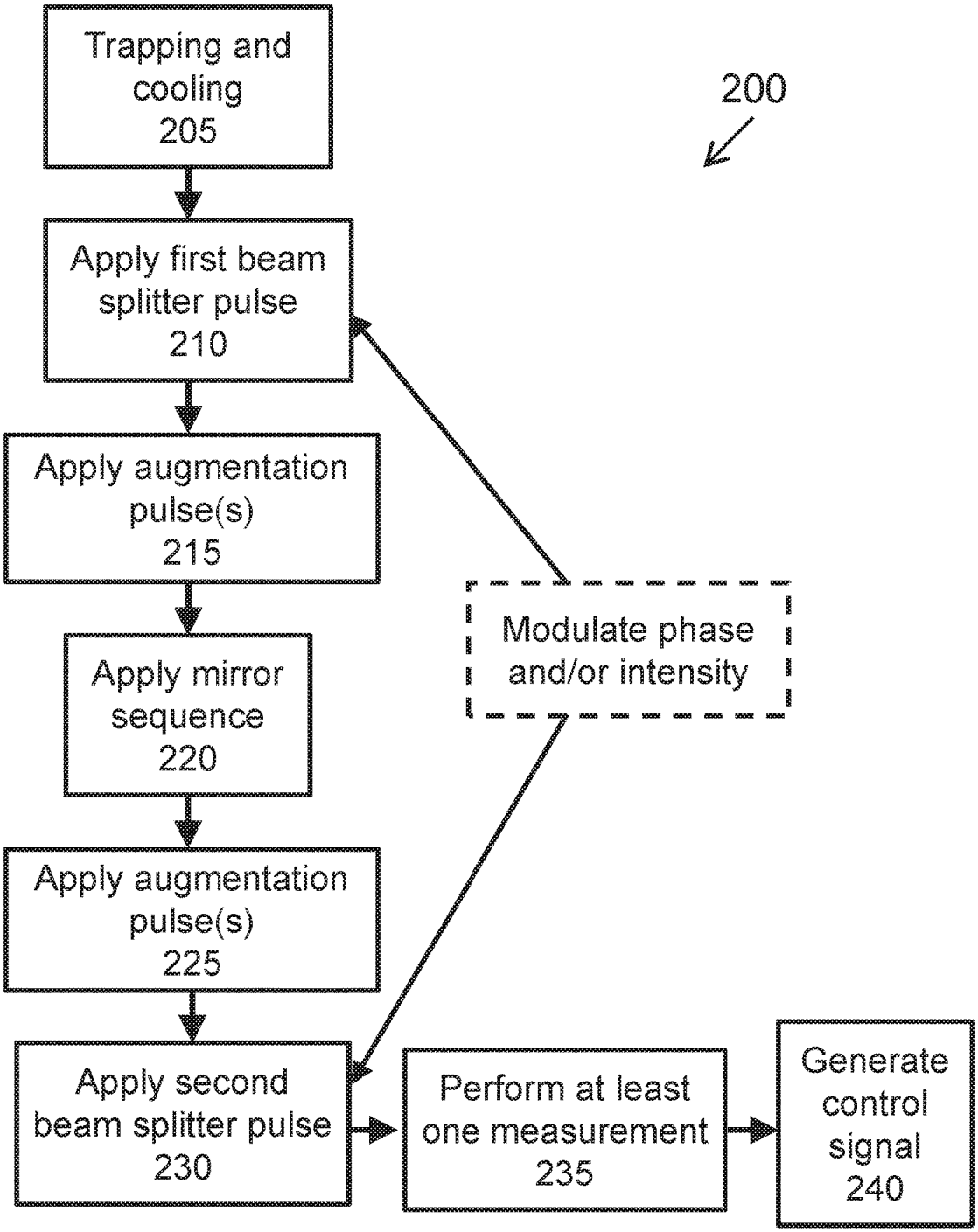
FIG. 17 is a flow diagram of one example of a method according to aspects of the invention.

FIG. 17 is a flow diagram of at least one example of a method 200 according to one or more aspects of the systems and devices discussed above. At step 205, a cloud of atoms may be trapped and cooled to a predetermined temperature suitable for inertial sensing, which in certain instances may be at least 9 micro-Kelvin. At step 210, a first beam splitter pulse may be applied to the cloud of atoms. At step 215 one or more augmentation pulses may be applied to the cloud of atoms. After a first predetermined dwell time, a mirror sequence may be applied to the cloud of atoms (step 220), and one or more augmentation pulses may then be applied to the cloud of atoms (step 225). After a second predetermined dwell time, a second beam splitter pulse sequence may be applied to the cloud of atoms (step 230). According to some embodiments, at least one of the first and the second beam splitter pulse sequences is a $\pi/2$ adiabatic rapid passage (ARP) pulse sequence, and the mirror sequence is a $\pi$ ARP sequence. As indicated in FIG. 17, according to certain aspects, the phase and/or intensity of at least one of the first and the second beam splitter pulse sequences may be modulated. At step 235 at least one measurement may be performed during an interrogation time, and at step 240 a control signal, such as a control signal, may be generated based on the at least one measurement. According to various aspects, the control signal may be used to control one or more operations in a navigation device or system, for example, in operations related to determining location. For instance, measurements related to acceleration or rotation sensing may be used to generate a control signal that is then used by a navigation device.

The aspects disclosed herein in accordance with the present invention, are not limited in their application to the details of construction and the arrangement of components set forth in the following description or illustrated in the accompanying drawings. These aspects are capable of assuming other embodiments and of being practiced or of being carried out in various ways. Examples of specific implementations are provided herein for illustrative purposes only and are not intended to be limiting. In particular, acts, components, elements, and features discussed in connection with any one or more embodiments are not intended to be excluded from a similar role in any other embodiments.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. In addition, in the event of inconsistent usages of terms between this document and documents incorporated herein by reference, the term usage in the incorporated reference is supplementary to that of this document; for irreconcilable inconsistencies, the term usage in this document controls. Moreover, titles or subtitles may be used in the specification for the convenience of a reader, which shall have no influence on the scope of the present invention.

Having thus described several aspects of at least one example, it is to be appreciated that various alterations, modifications, and improvements will readily occur to those skilled in the art. For instance, examples disclosed herein may also be used in other contexts. Such alterations, modifications, and improvements are intended to be part of this disclosure, and are intended to be within the scope of the examples discussed herein. Accordingly, the foregoing description and drawings are by way of example only.

What is claimed is:

1. A method for inducing momentum transfer, comprising:

trapping and cooling an atom cloud including a plurality of atoms;

applying a sequence of adiabatic rapid passage (ARP) light pulses to the plurality of atoms to induce momentum transfer, the sequence including:

applying a first $\pi/2$ ARP sweep;

after a first dwell time subsequent to the first $\pi/2$ ARP sweep, applying a mirror $\pi$ ARP sweep; and after a second dwell time subsequent to the mirror $\pi$ ARP sweep, applying a second $\pi/2$ ARP sweep;

applying a sequence of ARP augmentation pulses to the plurality of atoms to induce additional momentum transfer, the sequence including:

applying at least one ARP augmentation pulse subsequent to applying the first $\pi/2$ ARP sweep and prior to applying the mirror ARP sweep; and applying at least one ARP augmentation pulse subsequent to applying the mirror ARP sweep and prior to applying the second $\pi/2$ ARP sweep;

modulating at least one of a phase and an intensity of at least one of the first and the second $\pi/2$ ARP sweeps;

performing at least one measurement associated with induced momentum transfer of the atom cloud;

generating a control signal based on the at least one measurement; and calculating an acceleration sensitivity parameter.

2. The method of claim 1, wherein the at least one measurement includes measuring at least one of an acceleration and a rotation of at least a portion of the plurality of atoms forming the atom cloud.

3. The method of claim 1, wherein the at least one measurement is performed during an interrogation time of at least 1 millisecond.

4. The method of claim 3, wherein the at least one measurement is performed during an interrogation time is in a range from 1 to 17 milliseconds.

5. The method of claim 1, wherein the sequence of ARP light pulses are applied at a Rabi frequency of at least 88 kHz.

6. An atom interferometer, comprising:

an atom cloud including a plurality of atoms;

a trap configured to trap and cool the plurality of atoms to a predetermined temperature and launch the plurality of atoms into an interferometry region;

at least one laser light source disposed adjacent to the interferometry region and configured to apply a sequence of adiabatic rapid passage (ARP) light pulses to the interferometry region and to apply a sequence of ARP augmentation pulses to the interferometry region;

an electro-optic modulator coupled to the at least one laser light source and configured to sweep a Raman detuning frequency of the light pulses;

an amplifier coupled to the at least one laser light source and configured to modulate an optical intensity of the at least one laser light source; and a controller coupled to the at least one laser light source, the electro-optic modulator, and the amplifier and configured to:

direct the sequence of ARP light pulses at the atom cloud to induce adiabatic transitions between internal quantum levels of at least a fraction of the plurality of atoms during the sequence of ARP light pulses;

direct the sequence of ARP augmentation pulses at the atom cloud;

obtain at least one measurement from the atom cloud based on the adiabatic transitions; and calculate an acceleration sensitivity parameter.

7. The atom interferometer of claim 6, wherein the at least one laser light source comprises counter-propagating beams of light directed at the atom cloud.

8. The atom interferometer of claim 6, wherein the at least one laser light source is configured to apply the sequence of ARP light pulses at a Rabi frequency of at least 88 kHz.

9. The atom interferometer of claim 8, wherein the Rabi frequency is about 250 kHz.

10. The atom interferometer of claim 6, wherein the at least one laser light source has a $1/e^2$ diameter of 7 mm.

11. The atom interferometer of claim 6 wherein the at least one measurement is a measurement of at least one of an acceleration and a rotation of at least a portion of the plurality of atoms forming the atom cloud.

12. A method for atomic time-keeping, comprising:

trapping and cooling a cloud of atoms to a predetermined temperature;

applying a first adiabatic rapid passage (ARP) beam splitter pulse to the cloud of atoms;

after a first predetermined dwell time, applying a second ARP beam splitter pulse to the cloud of atoms subsequent to applying the first ARP beam splitter pulse;

modulating at least one of a phase and an intensity of at least one of the first and the second ARP beam splitter pulses;

performing at least one measurement on the cloud of atoms during an interrogation time following the second ARP beam splitter pulse; and generating a clock signal based on the at least one measurement, wherein the clock signal achieves an Allan deviation of 8e-13 at $\tau$=200 seconds for measurements acquired at 0.89 Hz.

13. The method of claim 12, wherein applying the second ARP beam splitter pulse includes applying at least two $\pi/2$ ARP beam splitter pulses.

* * * * *